US011840441B2

(12) United States Patent
Sasturain et al.

(10) Patent No.: US 11,840,441 B2
(45) Date of Patent: Dec. 12, 2023

(54) CONTAINER COUPLING AND OPENING DEVICE WITH PROBE

(71) Applicant: BASF SE, Ludwigshafen am Rhein (DE)

(72) Inventors: Juan Sasturain, Limburgerhof (DE); Peter Lischetzki, Limburgerhof (DE); Robert Huber, Limburgerhof (DE)

( * ) Notice: Subject to any disclaimer, the term of this patent is extended or adjusted under 35 U.S.C. 154(b) by 1206 days.

(21) Appl. No.: 16/472,454

(22) PCT Filed: Dec. 21, 2017

(86) PCT No.: PCT/EP2017/084092
§ 371 (c)(1),
(2) Date: Jun. 21, 2019

(87) PCT Pub. No.: WO2018/115285
PCT Pub. Date: Jun. 28, 2018

(65) Prior Publication Data

US 2021/0340003 A1 Nov. 4, 2021

(30) Foreign Application Priority Data

Dec. 22, 2016 (EP) ..... 16206405

(51) Int. Cl.
*B67D 3/00* (2006.01)
*B08B 5/04* (2006.01)
(Continued)

(52) U.S. Cl.
CPC ..... *B67D 3/0032* (2013.01); *B08B 5/04* (2013.01); *B08B 9/093* (2013.01); *B08B 13/00* (2013.01);
(Continued)

(58) Field of Classification Search
CPC ..... B67D 3/0032; B65D 55/00; B65D 55/02; B65D 2555/00; B65D 2555/02; B08B 5/04; B08B 9/093; B08B 13/00; B08B 2209/08
See application file for complete search history.

(56) References Cited

U.S. PATENT DOCUMENTS 5,343,907 A * 9/1994 Wagner ..... B67D 1/07 141/90
5,816,298 A * 10/1998 Stricklin ..... F16L 41/16 141/351
(Continued)

FOREIGN PATENT DOCUMENTS

EP 2465815 A1 6/2012
KR 20160058857 A 5/2016
WO 0107321 A1 2/2001

OTHER PUBLICATIONS

International Search Report for International Application No. PCT/EP2017/084092, dated Mar. 22, 2018, 4 pages.

*Primary Examiner* — Timothy L Maust
(74) *Attorney, Agent, or Firm* — Armstrong Teasdale LLP

(57) ABSTRACT

Described herein is a coupling device configured to be mechanically coupled to a cap of a container to be in a coupled configuration. Also described herein are a corresponding method and a corresponding system. In one embodiment, the coupling device is used in combination with a crop protection spray system. The coupling device includes a single probe and a first and a second mechanical mechanism. The first and the second mechanical mechanisms are independent from each other. The first mechanism allows drawing the cap and the container towards the coupling device thereby sealing and locking the cap and the coupling device into a desired position. The second mechanism facilitates actually moving the probe thereby lifting the
(Continued)

Figure 1:
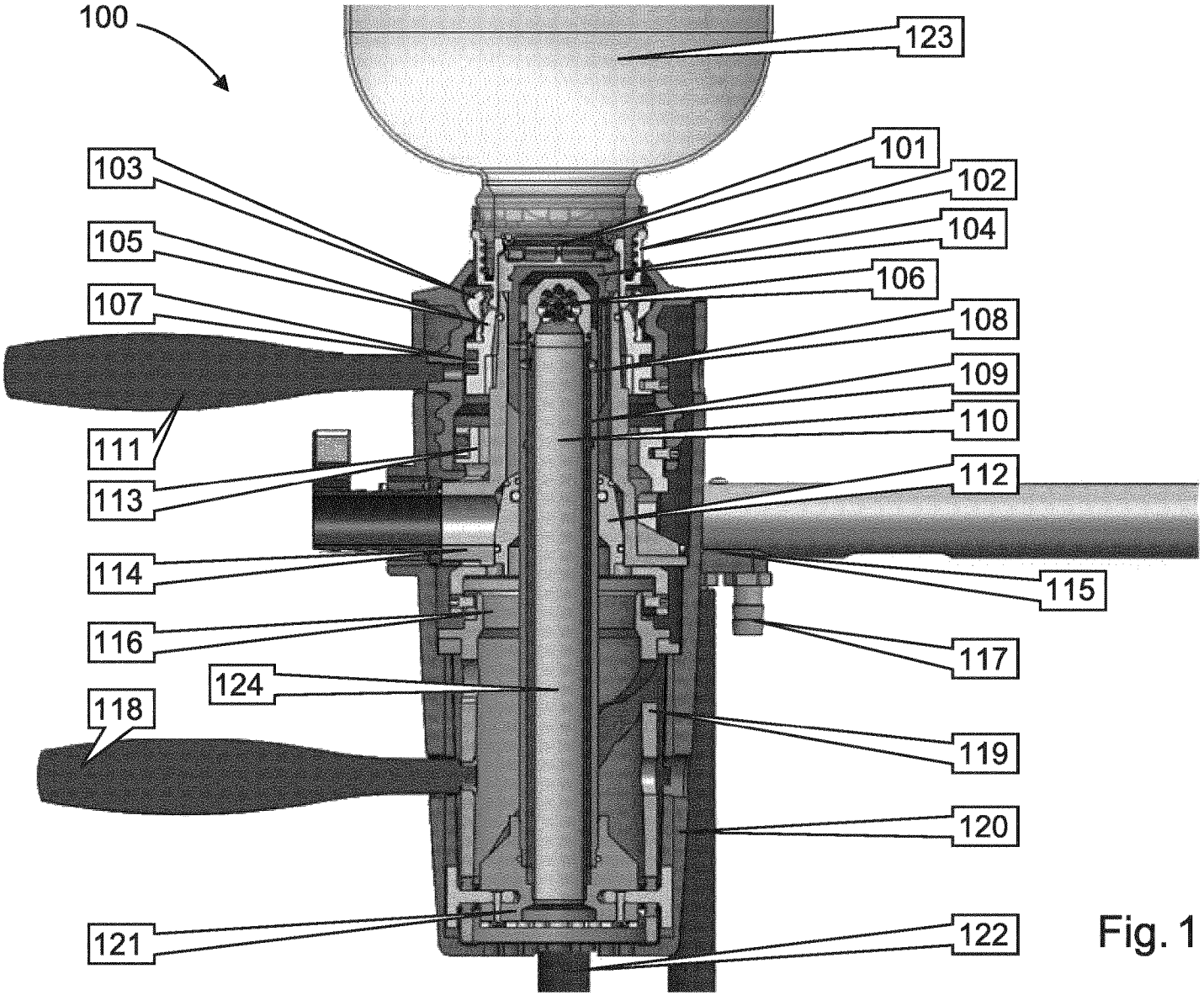

probe with the closure insert into the container. The coupling device may be embodied as a first, second and third tube which are arranged concentrically.

19 Claims, 16 Drawing Sheets

(51) Int. Cl.

| | |
|---|---|
| ***B08B 9/093*** | (2006.01) |
| ***B08B 13/00*** | (2006.01) |
| ***B65D 55/00*** | (2006.01) |
| ***B65D 55/02*** | (2006.01) |

(52) U.S. Cl.
CPC ..... *B08B 2209/08* (2013.01); *B65D 55/00* (2013.01); *B65D 55/02* (2013.01); *B65D 2555/00* (2013.01); *B65D 2555/02* (2013.01)

(56) References Cited

U.S. PATENT DOCUMENTS

| | | | | |
|---|---|---|---|---|
| 6,305,441 | B1 * | 10/2001 | Till | B67D 1/0837 141/90 |
| 7,353,848 | B2 * | 4/2008 | Krulitsch | B67C 3/2614 141/146 |
| 8,496,031 | B2 * | 7/2013 | Jenne | B67C 3/2614 141/285 |
| 9,802,807 | B2 | 10/2017 | Ware et al. | |
| 2011/0056981 | A1 | 3/2011 | Xiao et al. | |
| 2018/0029288 | A1 | 2/2018 | Von Vacano et al. | |
| 2019/0144256 | A1 * | 5/2019 | James | F16K 31/607 222/153.14 |
| 2022/0339678 | A1 * | 10/2022 | Ding | B08B 9/093 |
| 2023/0075267 | A1 * | 3/2023 | Freeston | B08B 3/02 |
| 2023/0191439 | A1 * | 6/2023 | Fontenit | B08B 9/093 134/18 |

* cited by examiner

CONTAINER COUPLING AND OPENING DEVICE WITH PROBE

CROSS-REFERENCE TO RELATED APPLICATIONS

This application is a U.S. National Phase Application of PCT/EP2017/084092, filed Dec. 21, 2017, which claims the benefit of priority to European Patent Application No. 16206405.9, filed Dec. 22, 2016, the entire contents of which are hereby incorporated by reference herein.

FIELD OF THE INVENTION

The present invention relates to the handling of liquids and solid-state media stored in containers which are opened and closed by means of a coupling device. In particular, the present invention relates to a coupling device configured to be mechanically coupled to a cap of a container, to a system for draining and venting a container, and to a method of mechanically coupling a coupling device to a cap of a container.

BACKGROUND OF THE INVENTION

In many technical fields, like for example in the field of liquids, liquids are used which may be hazardous for the user or operator. It is therefore a desire to provide for risk mitigation measures that reduce the chances of exposing the user with the chemically active substances. Moreover, during the transfer of the liquid the avoidance of spillages is desirable as well. Further, in some industries contamination of the liquids is strictly forbidden, like for example in food and beverage industries. Therefore, closed transfer systems (CTS) have been suggested for transporting liquids from a container into e.g. other receptacles or systems. However, the currently known systems are only available for large multi-trip containers or cause high costs due to the employment of complicated valve technology within the dispensing device of such closed transfer system. The opening and closure mechanism are also based on the application of metal springs which are necessarily needed for the activation and operation of the employed valves. Due to the high costs of such spring based opening- and closing-mechanisms, these opening and closure mechanisms are normally provided within the centrally used dispensing device, which is used for a plurality of different containers. Providing a container with a permanent cap that comprises such an expensive, metal spring based opening- and closing-mechanism is economically not desirable as the containers are used only once. Moreover, the container is not easily recycled if it comprises a metal spring. Therefore, the currently used containers merely comprise an opening with a one-time seal, e.g. a seal foil, on top of which an ordinary screw cap is provided. For draining the container, it is thus necessary to first remove the ordinary cap and to subsequently remove the seal or to puncture, i.e. to pierce, the seal foil with the dispensing device which comprises the closure mechanism. Hence, after decoupling the dispensing device the seal foil is attached to the container opening in a destroyed configuration and no automatic closure of the opening of the container is provided after decoupling the dispensing device. However, such a situation disadvantageously bares the risk of both contamination and leakage. Further, an unintentional decoupling during the process of draining may cause large spillages and may create an additional operator risk.

In the state of the art, probes with extraction apertures are used which are closed by means of sealed and sliding sleeves which are only actuated by springs. However, the inventors of the present invention found that it may be the case that the movement of the sleeves can be incomplete due to an increase in friction or failure of the spring to overcome the friction leaving the probes open while the coupling device is removed from the cap and the container. This may allow liquid to escape which in turn increases potential contamination of the operator.

SUMMARY OF THE INVENTION

There may be a need for an improved coupling between such coupling devices and the cap of the container.

It may be seen as an object of the present invention to provide for an improved coupling between such coupling devices and the cap of the container. The object is solved by the subject-matter of the independent claims. Further aspects, embodiments and advantages of the present invention are comprised by the dependent claims.

The following detailed description of the present invention similarly pertains to the coupling device, the system for draining and venting the container and the method of mechanically coupling the coupling device to the cap of the container. In other words, synergetic effects may arise from different combinations of the embodiments although they may not be described hereinafter explicitly.

The features of different embodiments can be combined unless explicitly stated otherwise hereinafter. Moreover, any reference signs in the claims should not be construed as limiting the scope of the claims. The method described herein may also be carried out in an order of steps that is different than the order explicitly mentioned herein, unless explicitly stated otherwise hereinafter.

Before the invention is described in detail with respect to some of its preferred embodiments, the following general definitions are provided.

The present invention is illustratively described in the following and may be suitably practiced in the absence of any element or any elements, limitation or limitations not specifically disclosed herein.

The present invention will be described with respect to particular embodiments and with reference to certain Figures, but the invention is not limited thereto, but only by the claims.

Wherever the term "comprising" is used in the present description and claims it does not exclude other elements. For the purpose of the present invention the term "consisting of" is considered to be a preferred embodiment of the term "comprising of". If hereinafter a group is defined to comprise at least a certain number of embodiments, this is also to be understood to disclose a group which preferably consists only of these embodiments.

Where an indefinite or definite article is used when referring to a singular noun, e. g. "a", "an", or "the", this includes a plurality of that noun, unless something else is specifically stated hereinafter. The terms "about" or "approximately" in the context of the present invention denote an interval of accuracy that the person skilled in the art will understand to still ensure the technical effect of the feature in question. The term "typically" indicates deviation from the indicated numerical value of plus/minus 20 percent, preferably plus/minus 15 percent, more preferably plus/minus 10 percent, and even more preferably plus/minus 5 percent. Technical terms are used herein by their common sense. If a specific meaning is conveyed to certain terms, definitions of terms will be given in the following in the context of which the terms are used.

The term "cap" as used herein shall be understood as a sealing cap and/or as a cap for closing the inlet of the container. Different attachment means may be used for attaching the cap to the inlet opening of the container or to the neck where the inlet opening is positioned. For example, an internal thread or an external thread comprised by the cap may be used to engage the cap with the inlet opening which may comprise a corresponding counter-thread. However, other attachment means, like for example a click and snap closure or a fixation of the cap at the container with glue, may be used for attaching the cap to the container.

The term "closure insert" as used herein shall be understood as a plug or a stuff that can be inserted into the cap by inserting it into an opening of the cap. The closure insert, when in its inserted position and when engaging with the cap, e.g. a shoulder of the cap, in a fluid tight manner, realizes releasably a closing function of the cap. The closure insert may have essentially the same diameter as the corresponding opening of the cap. More technical details about these closure inserts as used in the context of the present invention will be described hereinafter. The closure insert may comprise a sealing ring or other sealing elements so as to releasably seal the opening of the cap. Different materials may be used, but, as will be explained in detail, materials resistant to the used liquid are preferred. Specific embodiments of said materials for the sealing plugs, i.e. the closure inserts, are presented hereinafter. In particular, the closure inserts or plugs in the cap may have a spring function derived from a material memory in the legs of the plug and this is used to retain the plugs in position and sealed.

Moreover, the term "shoulder" shall be understood as any kind of shape or contour of the sidewall which facilitates the desired engagement with at least a part of the respective closure insert with the cap. Particularly, a shoulder may be embodied as a protrusion which extends from the sidewall of an opening of the cap such that a counterpart of the corresponding closure insert can engage with the shoulder in fluid tight manner when the shoulder and the closure insert are pushed or pressed towards each other. The coupling device is configured, when in the coupled configuration, to disengage the closure insert of the cap from the cap by axially pushing the closure insert with the probe. Different embodiments and more details about said shoulders will be provided hereinafter.

As will be explained in detail, the cap may comprise a closure insert, wherein the opening of the cap may be surrounded by a circumferential wall. The circumferential wall comprises a shoulder and the closure insert releasably engages with the shoulder such that the opening is fluid tightly closed. The closure insert may thus engage with the corresponding shoulder such that upon axially pushing the closure insert towards the bottom of the container body said closure insert disengages with the corresponding shoulder to be in a disengaged configuration and upon axially pulling said closure insert from the disengaged configuration and in a direction away from the bottom of the container body said closure insert re-engages with the corresponding shoulder such that the corresponding opening is again fluid tightly closed. This can be gathered from e.g. FIGS. 1 to 10.

Furthermore, although the working principle and some embodiments of the present invention are described in combination with a liquid in the container, also solid state materials, or gases, or in any combination thereof, can be stored in the container without departing from the present invention. The liquid and may also be comprised in the container in pure form or in combination with different materials like a solvent or several solvents. Further, the adjuvant may be comprised by the container in pure form or in a combination with a liquid. For example, a plant protection chemical or a plant protection adjuvant or a combination thereof may be the liquid in the container of the present invention.

It should be noted, that in the context of the present invention the term "distal" is used in the following sense. A movement of the probe in distal direction is to be understood as a movement towards the cap and towards the bottom of the container on which the cap is provided.

According to a first aspect of the present invention, a coupling device configured to be mechanically coupled to a cap of a container to be in a coupled configuration is presented. The coupling device comprises a probe configured to be inserted into an opening of the cap. The coupling device is configured, when in the coupled configuration, to disengage a closure insert of the cap from the cap by axially pushing the closure insert with the probe. The coupling device further comprises a first mechanism which is configured for drawing the cap and the container towards the coupling device. The coupling device also comprises a second mechanism configured for axially moving the probe to thereby lift the probe with the closure insert into the container.

In an embodiment, the first mechanism is configured for drawing the cap and the container towards the coupling device for sealing and locking the cap and the coupling device into a desired position.

Several different ways of embodying the first and second mechanisms are possible and will be described hereinafter in the context of detailed embodiments. Further, a preferred application of the coupling device is the combination with a container and a crop protection spray system.

As will become apparent from the following explanation, the first mechanism is used for fluid-tightly sealing the container and the cap with the coupling device as well as for the mechanical connection of coupler and the container with the cap. And the second mechanism is used for independently moving the probe thereby opening the opening of the cap and thus allowing sucking container material out of the container, venting the container simultaneously with air and/or rinsing the container with a liquid.

The coupling device of the present invention is thus limited by the first and second mechanisms, which do provide respective configurations. In particular, the first mechanism is configured, when being in a coupled configuration with the container and the cap, for drawing the cap and the container towards the coupling device for sealing and locking the cap and the coupling device into a desired position. Clearly, the skilled person can determine whether a coupling device in question has a first mechanism with the claimed configuration. When the coupling device is brought into contact with the cap of the container, and when by activating or using the first mechanism the container with the cap is drawn towards the coupling device for sealing and locking the cap and the coupling device into a desired position, this first mechanism fulfils the requirement of the present invention. The same holds true for the second mechanism, which is configured for axially moving the probe to thereby lift the probe with the closure insert into the container. The skilled person can determine whether a coupling device in question has a second mechanism with the claimed configuration. If the probe, upon activating or using the second mechanism, is axially moved and lifted with the closure insert into the container, the coupling device in question comprises also a second mechanism, which fulfils the configuration as claimed. Consequently, the configurations of the first and second mechanisms can be directly and positively verified by tests or procedures which do not require undue experimentation by the skilled person.

It should be noted, that the coupling device of the present invention can be used in combination with rigid containers and also with flexible containers. Further, different lengths and geometrical dimensions can be chosen according to the desired purpose of the coupling device and can be selected by the user.

Advantageously, a secure and reliable connection between the coupling device and the container can be achieved. The provided coupling device allows for draining the liquid via the opening of the cap and allows for venting the container simultaneously via the opening of the cap. Advantageously, the cap can be permanently fixed to the container, i.e. before, during and after draining, venting and/or washing the container. Said steps of draining, venting and/or washing shall be understood to be part of an embodiment of the present invention. Further, such a coupling device facilitates that upon disconnecting the coupling device from a container an automatic resealing of the container is triggered or caused. Thus, the coupling device of the present invention facilitates that the container is rendered back to a safe state without exposure or spillage as soon as the coupling device is removed. The container as presented herein facilitates the provision and use of a valuable closed transfer system for transferring the liquid from the container. This may be especially valuable in the field of Crop Protection Products (CPP). Moreover, this coupling device provides for a reliable, single material and low cost closing mechanism which is permanently fixed at the container. These aspects and functionalities of the coupling device and of the container will be described and elucidated in more detail hereinafter.

A direct and clean connection can be established between the container (comprising the cap) and a device, for example a crop protection spray system. The coupling device of the present invention, as disclosed hereinafter in more detail, can be used for this purpose. The risk of operator exposure to the concentrate can be reduced compared to current practices with standard containers, which will become apparent form the following explanations. The presented container provides for connectivity without using complex devices in the closure that are difficult to recover or reduce the capacity for post use recycling. Hence, the provided container reduces the complexity of the closure system and at the same time provides for a recyclable container comprising the springless cap. The coupling device of the present invention allows for a passage of liquid from the container and allows for a simultaneous passage of air into the container through the single opening. Further, rinsing water can be guided into the container and rinsate can be guided simultaneously out of the container using this single opening. If the requirement for closed transfer is mandated or enforced through other regulatory controls, the cap can be permanently attached to the container preventing any use except through a closed transfer system but which is an unavoidable engineered safety solution.

Opening the container and transfer with a closed transfer system can be followed by re-closure of the container and storage for later use while maintaining the minimal exposure risk. The closure technique provided by the cap eliminates the current barrier between safe techniques for small and large packs and reduces the end users requirement for equipment to just one coupling device, the coupling device of the present invention. The functionality of a releasable, fluid tight engagement between the closure inserts and the surrounding walls of the openings of the cap may be seen as a valve function, which will be described hereinafter.

The inventors found that when a chemical container is connected to a sprayer in the process of emptying the contents it is convenient to provide the operator with a means to control the speed of emptying and the amount of effort applied by the sprayer so that the chemical product flows at rate that is acceptable and irrespective of the size or strength of the container and allows the operator to make accurate measurement of the volume transferred through a suitable measuring device which could be volumetric, flow meter, mass based or any other appropriate device.

According to this embodiment of the present invention the coupling device is used together with a cap which is provided in a springless form. Therefore, the cap does not comprise a spring, particularly not a metal spring. Thus, a metal free container and a metal free cap, which is permanently fixed on the container, can be provided. This increases the acceptability of the container (including the cap) for recycling. Moreover, the engagement between the closure inserts and the respective shoulders of the cap walls may be seen as a valve or as providing for a valve function. In other words, the cap comprises a fluid tight closing and opening valve mechanism which works without using a spring in the cap. Thus, the cap of the container may be a springless cap in all embodiments.

If desired, the cap in this and every other embodiment mentioned herein can additionally be embodied as a springless and elastomer free cap. This may be embodied as a single material container and cap configuration.

In a preferred embodiment, the coupling device is a mono probe coupling device comprising only a single probe. This embodiment can be seen for example from FIGS. 1, 11, 13 and 14. The coupling device of the present invention may be particularly used for the draining and venting of crop protection product containers. However, the coupling device of the present invention can also be used together with any kind of container comprising any kind of subject-matter. As will be explained later on, this coupling device provides for a convenient draining and cleaning of the container. It also provides for safety measures ensuring that emptying the container is only possible when a fluid-tight connection between the cap and the coupling device is established. This is realized by the two independent mechanisms comprised by the coupling device.

The two different and separate mechanisms of the coupling device allow for an independent adjustability of the suction opening, which can be adjusted independent from the actual position of the probe of the coupling device. This will be explained in more detail hereinafter in the context of the embodiment described with respect to FIGS. 1 to 10.

In particular, in an embodiment, the first and the second mechanisms are decoupled so called "Kulissenmechaniken", which is known to the skilled person. In a further specified embodiment, tubes are provided which comprise inner and/or outer profiles along which other components of the coupling device are moved along.

The coupling device of the present invention, in a preferred embodiment, is configured to be positioned in an upright position such that the container is put on top of the coupling device. This can be seen, for example, from the embodiment of FIG. 1.

The first mechanism ensures that the cap and the container are drawn towards the coupling device such that a fluid-tight sealing and locking of the cap and the container with the coupling device can be achieved. The second mechanism can then be used subsequently for actually moving the probe of the coupling device in distal directions and thereby towards the closure insert which resides on the opening of the container cap. The drawing movement of the container with the cap may be initiated by using a first lever of the first mechanism which activates a motion link within the coupling device. Furthermore, the actual movement of the probe towards the closure insert may be activated or initiated by moving a second lever of the coupling device which causes a second motion link to move the probe accordingly. In the non-restricting and specific embodiment of FIG. 1, this will be explained in more detail.

In principle, any of the herein mentioned first, second and further levers may be moved horizontally or vertically to activate the corresponding mechanism. Translational movements may be combined with rotational movements as will be explained in more detail hereinafter.

In a particular embodiment, the coupling device comprises a blocking mechanism. The blocking mechanism is configured to block the second lever as long as the first lever is not in its end position. Furthermore, the blocking mechanism is configured to then block the first lever as soon as the second lever is moved away from its start position.

In other words, the first mechanism is configured for sealing the cap and the coupling device 100 and is configured for locking the container and the cap at the coupling device in a desired position. In a preferred embodiment, the first and second mechanisms are both contained within the housing, besides respective levers which are used to operate the respective mechanisms.

According to another exemplary embodiment of the present invention, the first mechanism comprises a first lever and the second mechanism comprises a second lever. The first mechanism is embodied as a motion link mechanism converting a linear or rotational movement of the first lever of the first mechanism into a rotation. Furthermore, the second mechanism is embodied as a motion link mechanism converting a linear or rotational movement of the second lever of the second mechanism into a rotation.

Several different mechanical components and constructional architectures may be used within the coupling device to realize the first and the second conversion. In this embodiment, the coupling device uses the conversion of the linear or rotational movement of the first lever into a rotation for drawing the cap and the container towards the coupling device and for sealing and locking the cap and the coupling device into a desired position. Furthermore, in this embodiment, the coupling device uses the conversion of the linear or rotational movement of the second lever into a rotation for actually moving the probe towards the closure insert of the container.

As will be understood by the skilled person, a motion link is considered to be a mechanical linkage in the sense of an assembly of bodies connected to manage forces and movement.

According to another exemplary embodiment, the coupling device comprises a housing in which the first and second mechanisms are contained with the exception of the first and second lever of the first and second mechanism.

The integration of the first and second mechanism provides a failsafe and secure provision of the coupling device for the user. As can be gathered for example from the embodiments shown in FIGS. 1, 11 and 14, the entire motion link mechanisms for providing the desired drawing of the cap and the container towards the coupling and for actually moving the probe is integrated within the housing. Only the first and second lever extend outside of the housing such that the user can activate the first and second mechanism by pushing and/or rotating the first and/or second lever.

According to another exemplary embodiment of the present invention, the first and second mechanisms are configured to be operated separately.

In particular, the user can activate the movement for drawing the cap and the container towards the coupling device for sealing and locking the cap and the coupling device in the desired position independently from the second mechanism. However, in an embodiment, a blocking element is used which blocks the second lever unless the first lever is moved to its position where it is ensured that the sealing and locking of the cap and the coupling device is accomplished. Only if the first lever is moved into that position, the second lever can be moved from its starting position to its end position.

According to another exemplary embodiment of the present invention, the first mechanism is configured for preventing at the same time misuse by blocking any unintended movement of the second lever, wherein the second mechanism is configured for preventing at the same time misuse by blocking any unintended movement of the first lever.

For example, this embodiment can be realized as follows. The coupling device is configured such that a rotation of the transfer cylinder causes a vertical movement of a blocking bar, which is part of the coupling device, which blocks the rotation of the lifter. The rotation of the lifter causes the vertical movement of the second blocking bar, which blocks the rotation of the transfer cylinder. This can also be seen in the embodiment shown in FIG. 16.

According to another exemplary embodiment of the present invention, the coupling device comprises a first, a second and a third tube. Preferably, the first, second and third tube are arranged concentrically in the coupling device such that the first tube is enclosed by the second tube and the third tube and the second tube is enclosed by the third tube.

Such a concentric embodiment allows for a very compact design of the coupling device thereby allowing to suck any product out of the container through the volume which extends between the second and the third tube and to guide air into the container through the internal part of the first tube and to rinse liquid into the container through the volume which extends between the first and the second tube. A specific embodiment thereof will be described in the context of FIG. 13.

According to another exemplary embodiment of the present invention, the coupling device is configured for guiding air through the first tube and is configured for rinsing water into the container through the second tube and is configured for sucking liquid out of the container through the third tube.

The rinsing function is very important and is possible in different ways. First, by activating the rinsing nozzle and spraying rinsing water via the probe head into the container, which is continuous rinsing. Second, by turning the coupling device with the container in the upright position filling the container with some water and shaking the container back and forth to wash off the bottom of the container, which is batch-wise rinsing. The cleaning of the closure insert, coupling device and the hoses after partial transfer can be important as well, and will be described in more detail hereinafter. In an alternative embodiment, the rinsing water is guided in the inner tube and the air is guided between the first and the second tube.

According to another exemplary embodiment of the invention, the coupling device comprises a suction gate for sucking liquid through the coupling device out of the container. The first and second mechanisms are configured for providing an adjustment of a size of an opening of the suction gate which adjustment is independent from a current axial position of the probe.

In prior art solutions in which the dosing is started and stopped by lifting the plug out of the cap and reclosing by lowering the plug into the cap, the air inlet of the probe is at the lowest point in the container during the complete dosing procedure. When reclosing lowering the plug means then the air inlet would be the opposite namely the highest point. As a consequence, in the prior art, the flow of liquid out of the container and the flow of air into the container are in such proximity that a shortcut for the air can be created. Air can be immediately sucked out of the container again, instead of replacing the volume of liquid extracted. This may lead to air bubble formation in the transfer hose and container deformation during dosing. Additional slow-down of transfer is possible as air is transferred. Deformation is less occurring when more liquid is sucked out than air can enter However, in the embodiment of the present invention, the two functionalities are separated allowing to start and stop the flow of liquid when the air inlet is in the highest possible position (maximum distance to the liquid outlet), thus completely avoiding air bubbles in the hose as well as avoiding any container deformation. Thus, a reduction of the hydrostatic deformation can be achieved as water column is shorter.

In other words, the suction gate may be seen as a valve which can be used for the following two purposes. First, when the product is transferred out of the container. In the specific embodiment of FIGS. 1 to 10, this is the case when the upper lever is positioned at 3 o'clock and the lower lever is positioned from 6 to 3 o'clock such that little to a lot suction can be adjusted. Second, when the outer side of the closure insert and the coupling device 100 with hoses is rinsed. In the embodiment of FIGS. 1 to 10, this is the case when the upper level is at 6 o'clock position and the lower level is at 9 o'clock position. To open the suction only at a certain position is an important feature of this embodiment to prevent that air is constantly sucked into the sprayer tank and causes foaming, this embodiment allows flushing the closure insert outside properly.

In particular, the embodiment using a single probe coupling device may exceed the performance of previously used and known double probe devices. The inventors of the present invention found that with the single probe device it is much easier to enter the probe further into the container reducing the static fluid pressure by reducing significantly the deformation of the bottles and increasing the emptying speed. Furthermore, by combining everything into concentric tubes, space could be economized so that the air tube could be separated from the rinsing tube. This additional functionality would have required a triple probe approach, which would not have fit into the available space. Having air and rinsing water separated, eliminated the container deformation that had been observed with dual probe constructions of the prior art during rinsing. This improves the rinsing efficacy of the coupling device of the present invention.

According to another exemplary embodiment of the present invention, the first mechanism comprises a first lever for operating the first mechanism. The first mechanism further comprises a claw element for drawing the cap and the container towards the coupling device and for locking the container and the cap into the desired position. The first lever is configured to be moved from a start position towards an end position. Moreover, the first lever is operatively connected to the claw element and is configured upon movement from the start position into a locking position, which may be between the start position and the end position, to radially move the claw element.

By using such a kinematic architecture within the coupling device, it is ensured that the container with the cap is grabbed by the claw element which then caused to move radially inwards to contact the cap and to go an axial movement away from the container to draw the container and the cap into the desired fluid-tight and fixed position within the coupling device. In particular, FIGS. 2, 3 and 4 disclose a specific mechanical embodiment of this aspect and explain how the construction can be realized.

According to another exemplary embodiment of the present invention, the first lever is further configured to be rotated for operating the first mechanism and the first mechanism further comprises a clamp cylinder and a transfer cylinder which comprises a motion link. The first lever is connected to the transfer cylinder such that the transfer cylinder follows a rotation of the first lever. The transfer cylinder is further configured upon rotation caused by the first lever to axially move the clamp cylinder. Moreover, the clamp cylinder is configured upon its axial movement to radially and axially move the claw element.

In other words, the first lever is operatively connected to the claw element by means of the clamp cylinder and the transfer cylinder.

According to another exemplary embodiment of the present invention, the coupling device further comprises a suction gate, wherein an opening defined by the suction gate is closed in the start position of the first lever. The first mechanism is further configured upon moving the first lever from the start position to an intermediate position to open the opening of the suction gate, and wherein the first mechanism is configured upon moving the first lever from the intermediate position to the end position to re-close the opening of the suction gate.

According to another exemplary embodiment of the present invention, the second mechanism comprises a second lever and a lifter which comprises a second motion link. The second lever is configured to be moved from a start position towards an end position. The second lever is also connected with the lifter and is configured upon movement from the start position to the end position to move the lifter. The lifter is configured to axially move the probe of the coupling device by the second motion link when the lifter is moved by the second lever.

In a preferred embodiment, this second mechanism is embodied as a Kulissenmechanik which is decoupled from the Kulissenmechanik described hereinbefore and hereinafter in the context of the first mechanism. Details about a further specified embodiment of this general architecture of the coupling device will be described in the context of particularly FIGS. 1 to 10.

According another exemplary embodiment of the present invention, the second mechanism is configured upon movement of the second lever from the start position towards the end position to gradually open the opening defined by the suction gate.

The gradual adjustment of the opening of the suction gate may be used when the product is transferred out of the container. Furthermore, this adjustability of the suction gate may be used when the outer side of the closure insert and the coupling device 100 with hoses are rinsed. In a specific embodiment, the coupling device ensures that the suction gate can only be opened in certain positions thereby preventing that air is constantly sucked in the sprayer tank and causes foaming and ensures that the closure insert is properly flushed at its outside.

According to another exemplary embodiment of the present invention, the coupling device is configured for rinsing outer parts of the cap and the closure insert, inner parts of the coupling device and transfer lines of the coupling device in a coupled configuration in which the closure insert fluid-tightly closes the opening of the cap.

Figure 2:
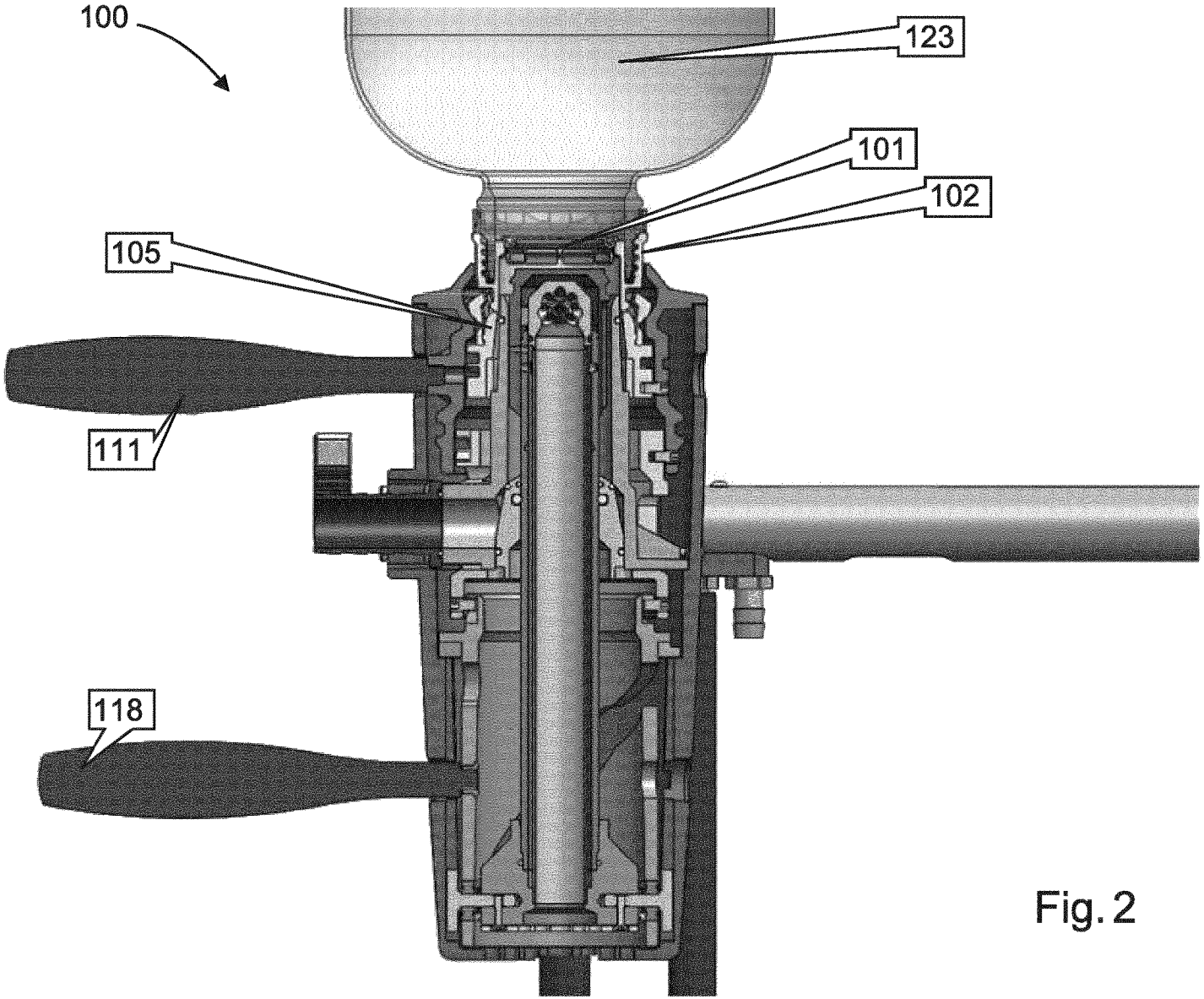
Figure 3:
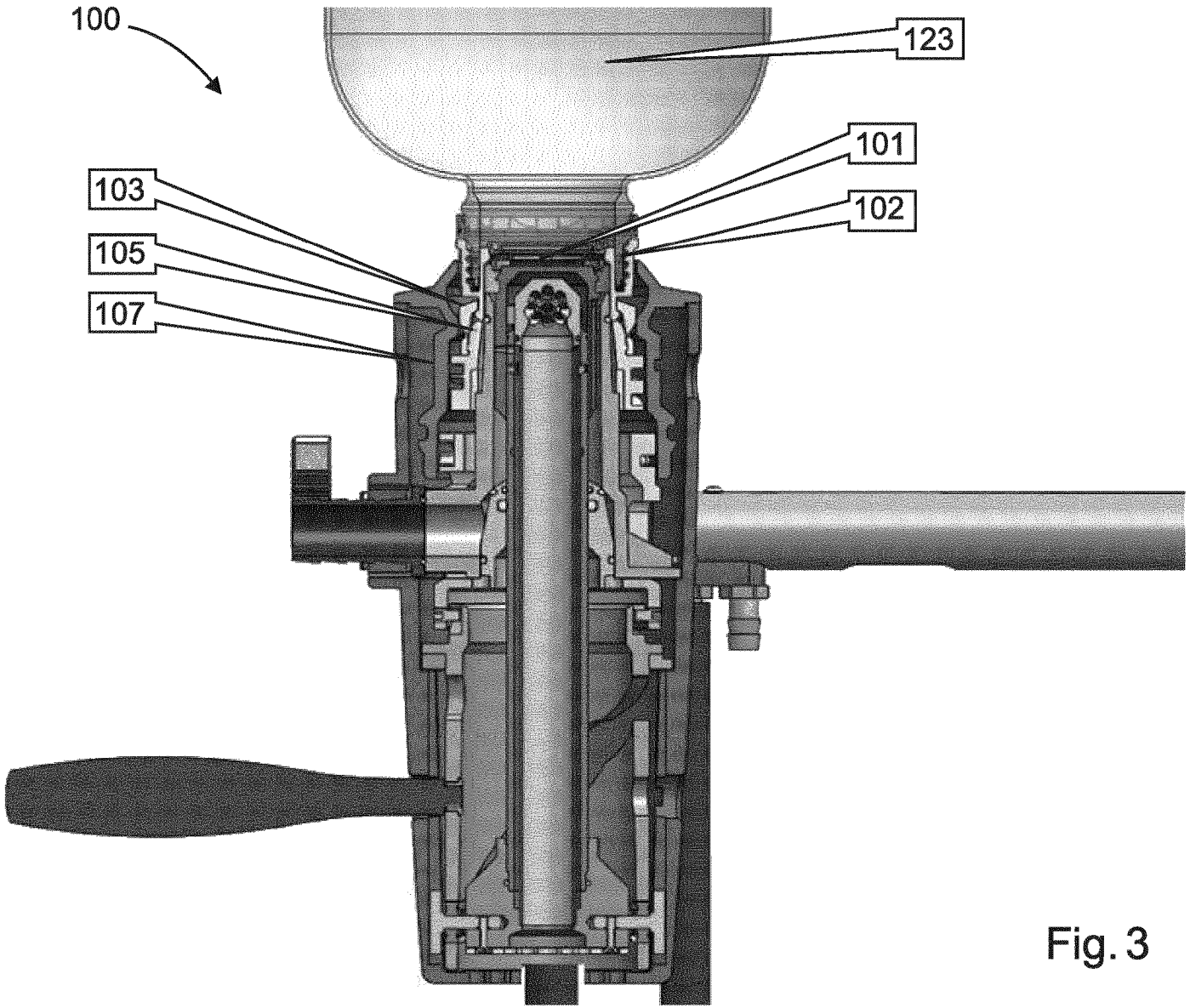
Figure 4:
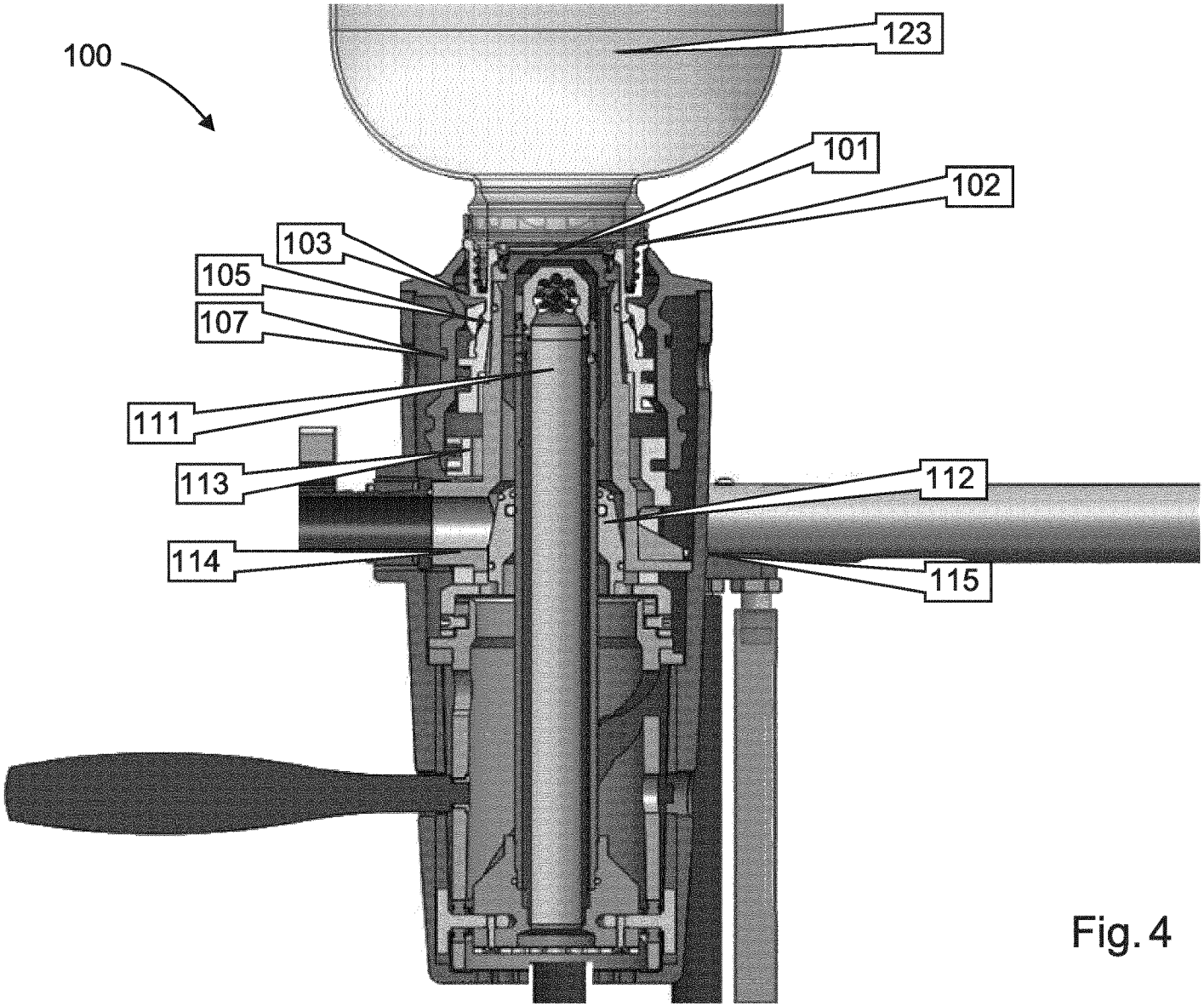

For example, in the embodiment shown in the context of the embodiment explained in FIGS. 2 to 4. In other words, this functionality allows rinsing the interior of the coupling device while the container is closed by the closure insert. This functionality may be essential when only a part of the content of the container is removed therefrom. In particular, in case crop production product is contained in the container, this may of high relevance.

According to another exemplary embodiment, the coupling device is configured for actively applying a suction pressure onto the liquid in the container to suck the liquid out of the container.

According to another exemplary embodiment of the present invention, a system for draining and venting a container is presented. The system comprises a coupling device as presented hereinafter and hereinbefore. Furthermore, the system comprises a container with a container body with at least one inlet opening. Moreover, the container comprises a cap for closing the inlet opening of the container body. The cap is attached to the inlet opening of the container body and the cap also comprises an opening, in which the probe of the coupling device is to be inserted. Furthermore, the cap comprises a closure insert. The closure insert releasably engages with the cap such that the opening of the cap is fluid-tightly closed.

According to another exemplary embodiment of the present invention, a method of mechanically coupling a coupling device to a cap of a container is presented. The method comprises the steps of placing the container onto the coupling device. The container body comprises at least one inlet opening and a cap attached to the inlet opening closing the inlet opening of the container. The cap comprises an opening and a closure insert which closes the opening of the cap. The method further comprises the steps of using a first mechanism of the coupling device thereby drawing the cap and the container towards the coupling device and thereby sealing and locking the cap and the coupling device 100 in a desired position at the coupling device. Furthermore, using a second mechanism of the coupling device thereby axially moving a probe of the coupling device to disengage the closure insert of the cap from the cap and thereby lifting the probe with the cap into the container is contained.

In a specific embodiment, the opening of the cap may be surrounded by a circumferential wall, wherein the circumferential wall comprises a shoulder and wherein the closure insert releasably engages with the shoulder such that the opening of the cap is fluid-tightly closed. This also holds true for a specific embodiment of the corresponding coupling device.

In another method step aligning the cap and the probe is accomplished. This is an important aspect of this movement. The inventors have hardly observed any plug failure in which the plug was not properly secured by probe head, since this embodiment ensures this alignment.

According to another exemplary embodiment, the method comprises rinsing outer parts of the cap, inner parts of the coupling device and transfer lines of the coupling device. The rinsing is carried out in a coupled configuration in which the closure insert fluid-tightly closes the opening of the cap. Furthermore, the rinsing is carried out by guiding a liquid through the coupling device towards the outer parts of the cap.

This embodiment may be important when only a part of the content of the container, e.g. a Crop Protection Product (CPP) container, has been removed. In this situation, the inner part of the container is not rinsed. The rinsing procedure described can be imperative to ensure the complete transfer of the product aliquot and remove any contamination from accessible surfaces.

The method steps as have been described before can be carried out by any of the coupling device shown and presented herein.

These and other features of the invention will be become apparent from and elucidated with reference to the embodiments described hereinafter.

Exemplary embodiments of the invention will be described in the following drawings.

FIGURES

FIG. 1 schematically shows an embodiment of a coupling device according to an exemplary embodiment of the present invention.

FIG. 2 schematically shows the coupling device of FIG. 1 where the container is placed upside down on the coupling device.

FIG. 3 schematically shows how the cap is secured to the coupling device in the embodiment of FIG. 1.

FIG. 4 schematically shows the sealing of the cap to the coupling device 100 and the open gate.

Figure 5:
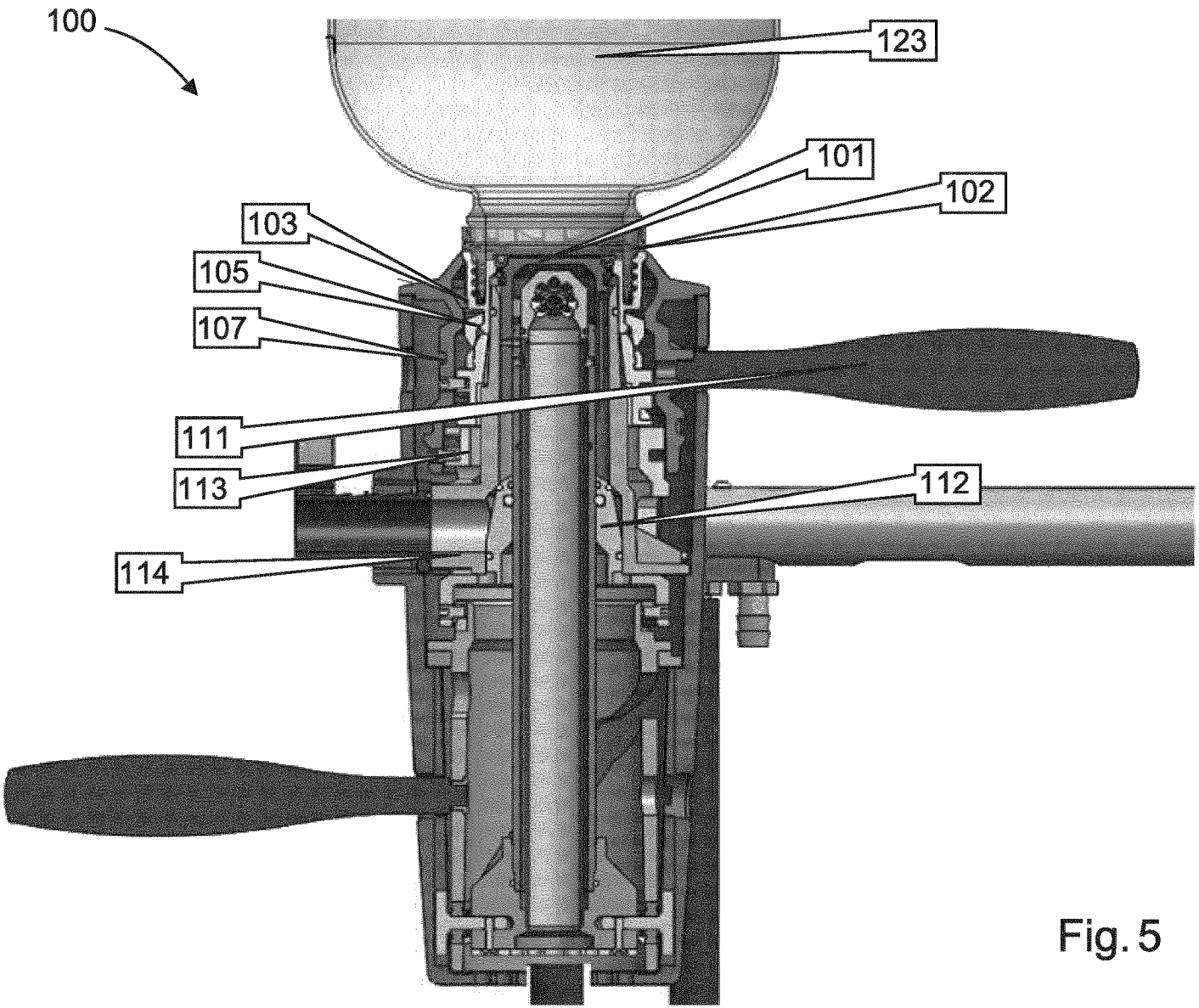

FIG. 5 schematically shows the locking of the container and the cap in the desired position and the reclosing of the gate.

Figure 6:
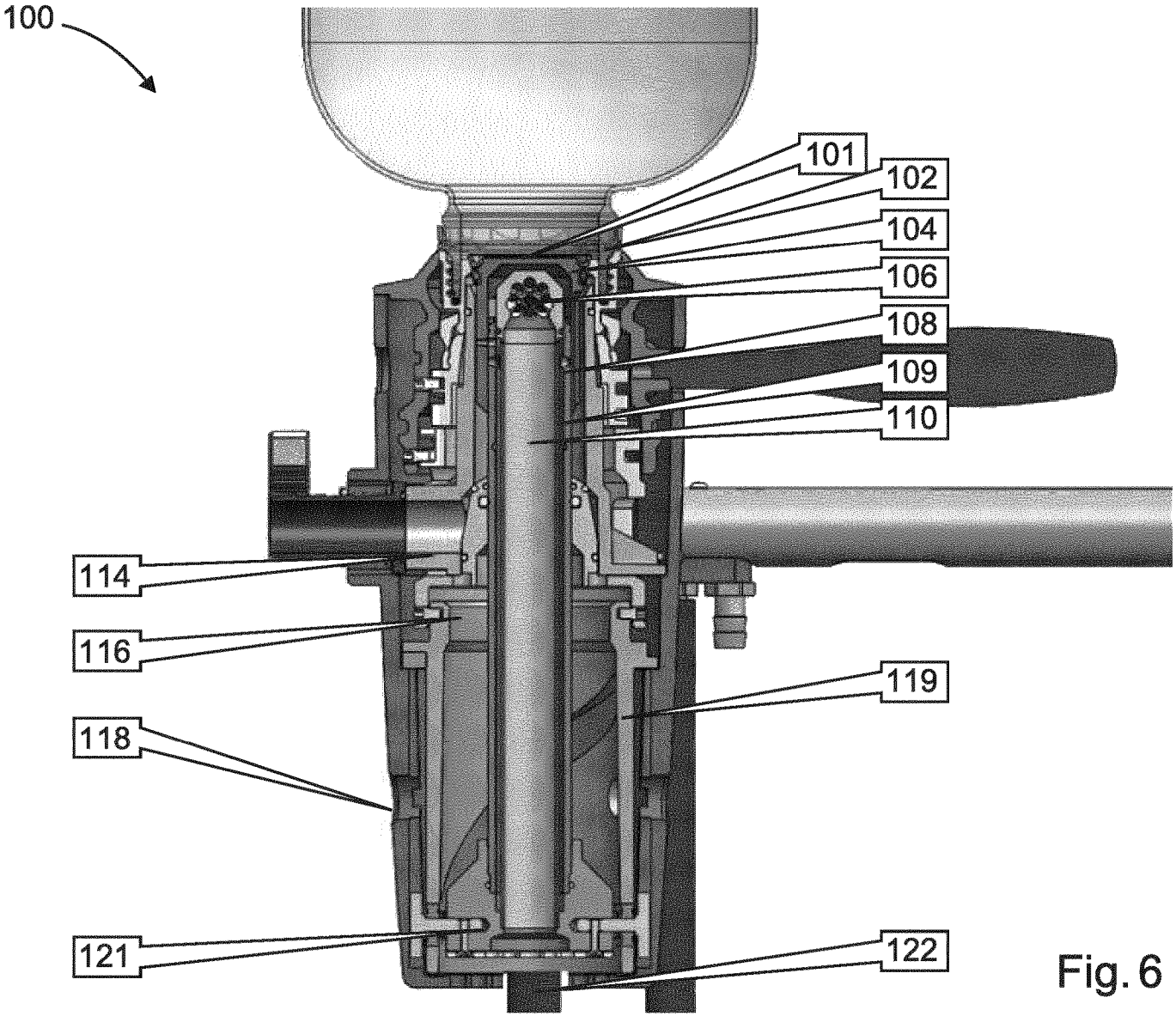

FIG. 6 schematically shows how the probe is advanced into the closure insert according to the embodiment of the coupling device of FIG. 1.

Figure 7:
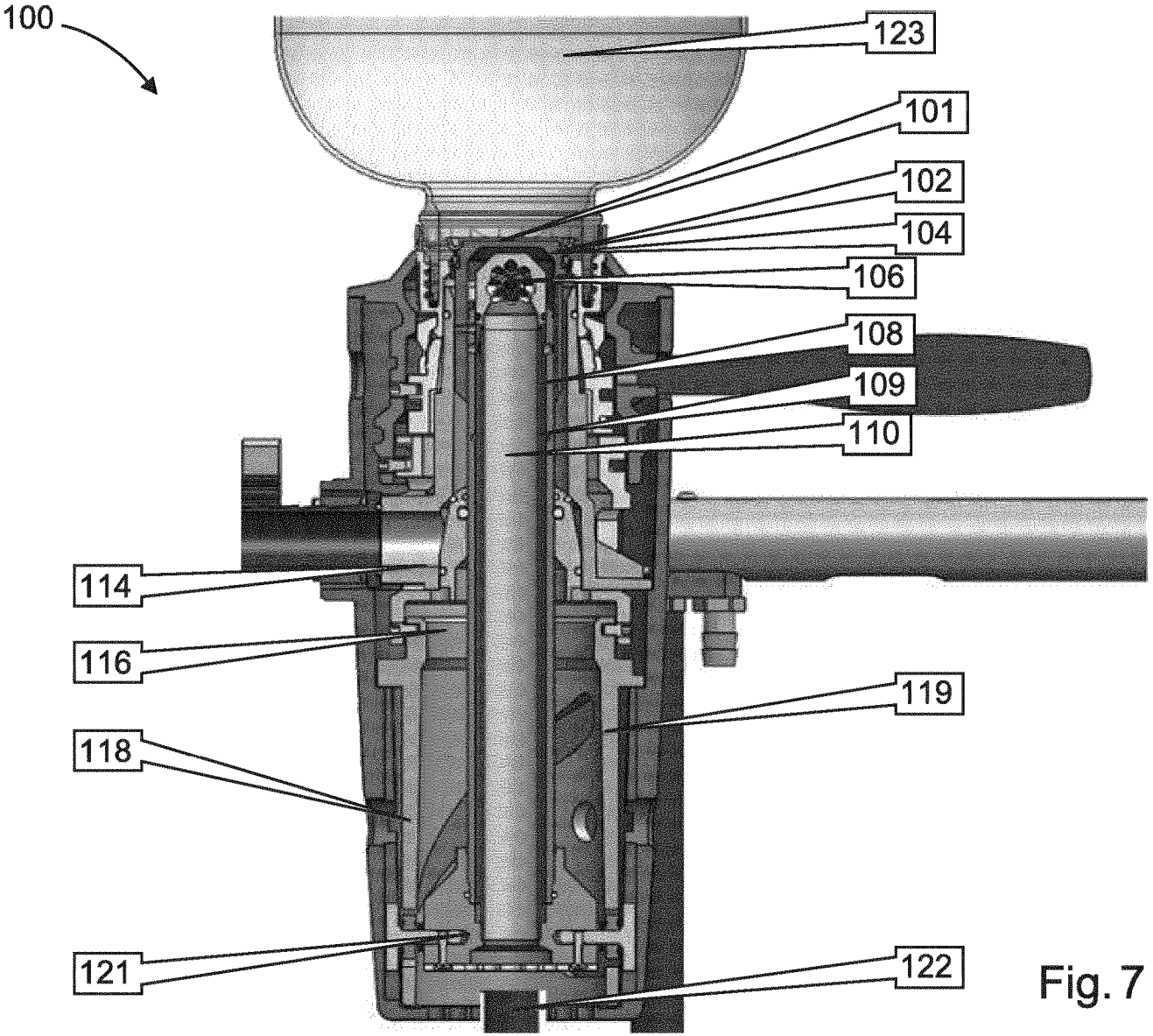

FIG. 7 schematically shows how the container is opened by lifting the closure insert from the cap in the embodiment of FIG. 1.

Figure 8:
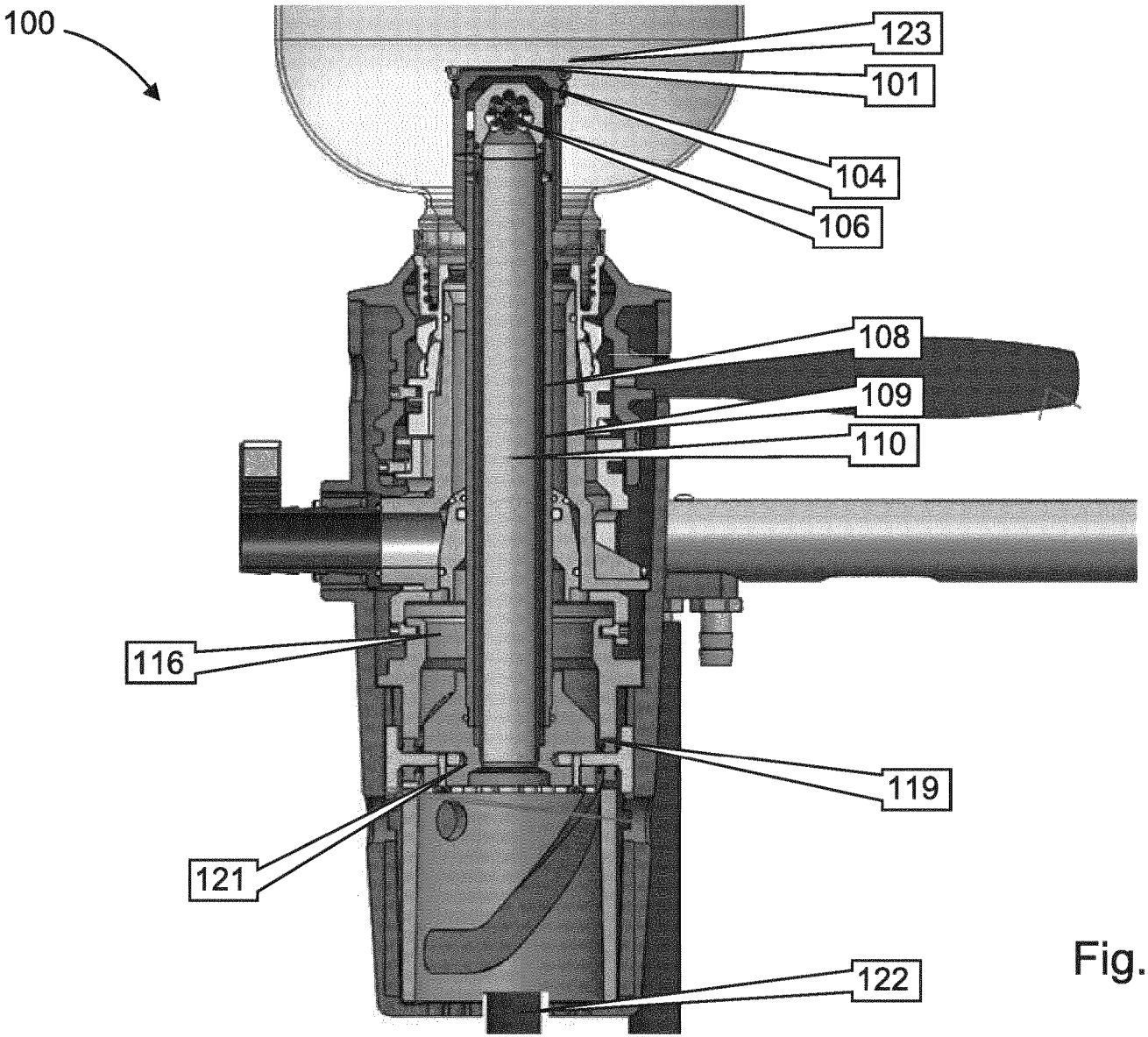

FIG. 8 schematically shows the lifting of the probe with the closure insert into the container in the embodiment of FIG. 1.

Figure 9:
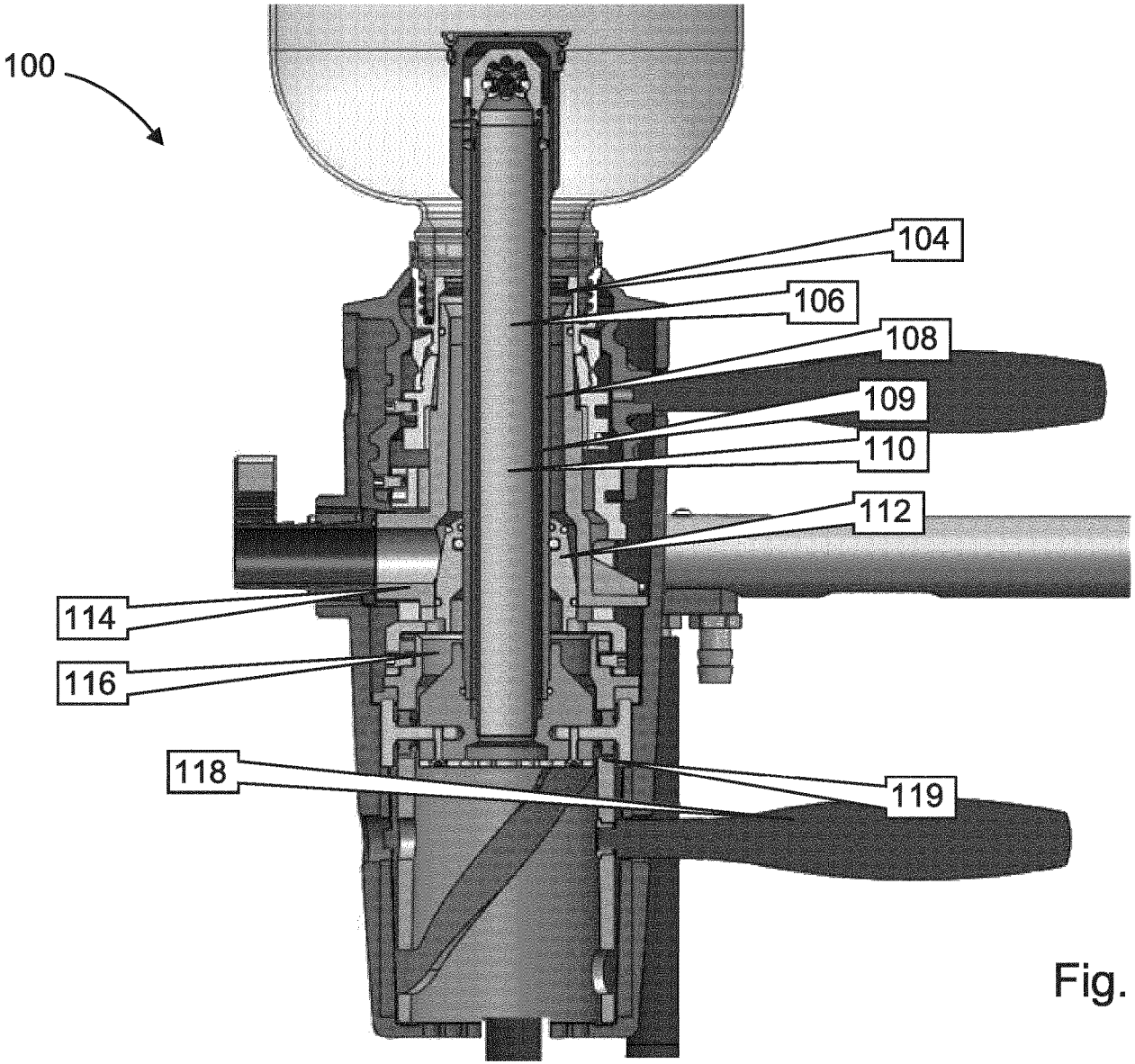

FIG. 9 schematically shows the start of a suction phase by opening the gate according to the embodiment of FIG. 1.

Figure 10:
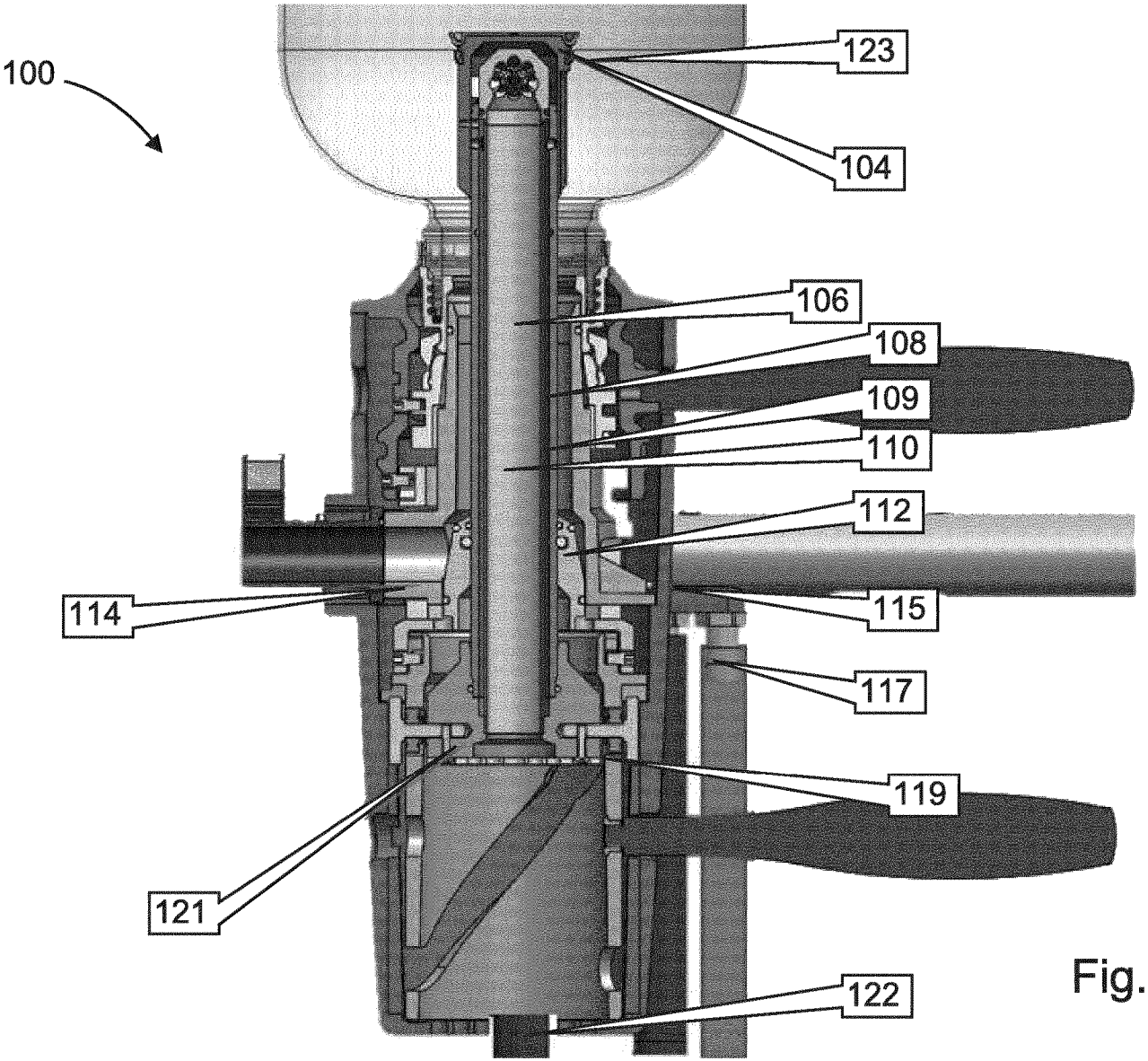

FIG. 10 schematically shows how rinsing water can be guided through the coupling device of FIG. 1 into the container.

FIGS. 11*a* to 11*d* show details of an embodiment where air and water intake is facilitated.

Figures 12A, 12B:
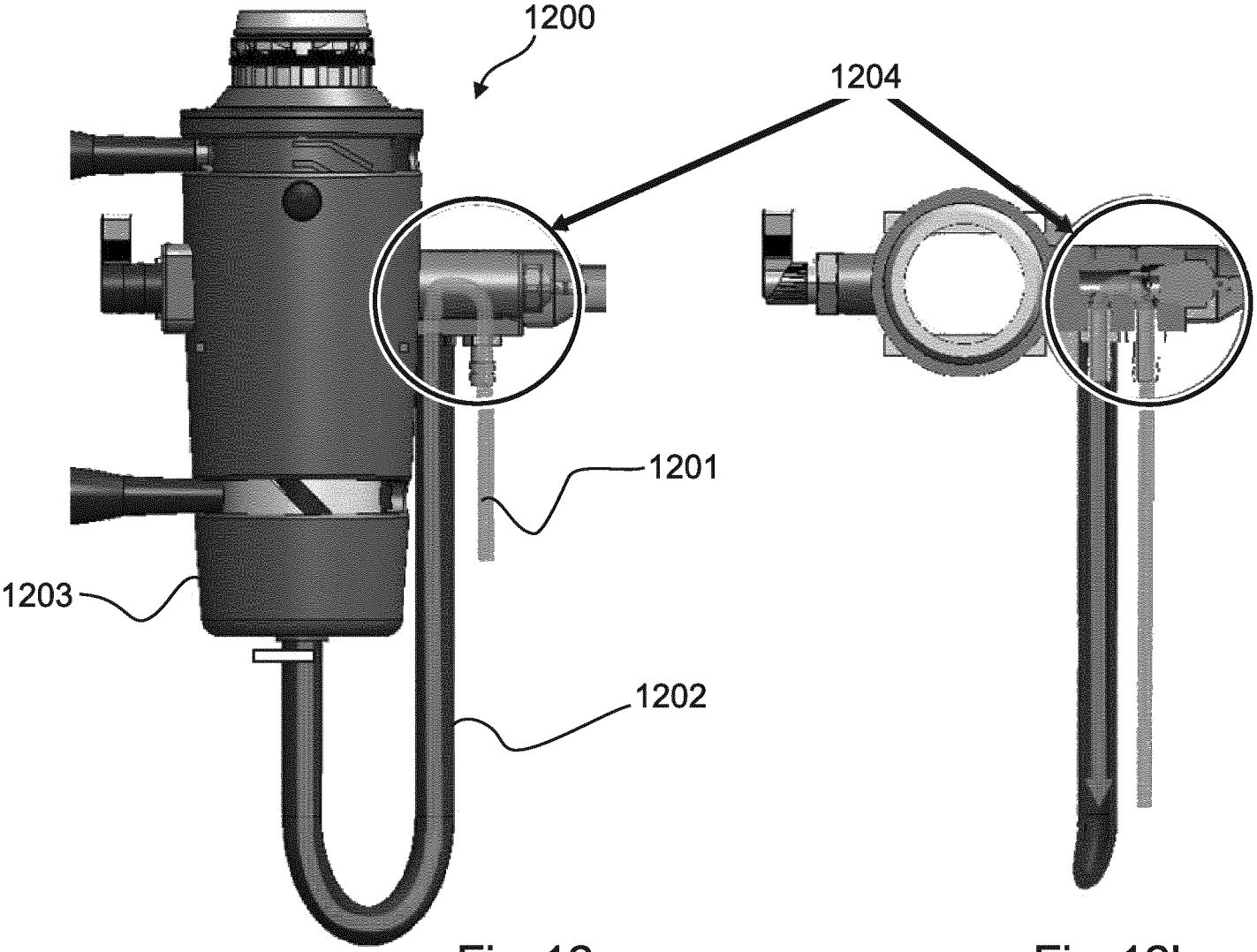

FIGS. 12*a* and 12*b* schematically show details about a rinsing water valve used in a coupling device according to another exemplary embodiment.

Figure 13:
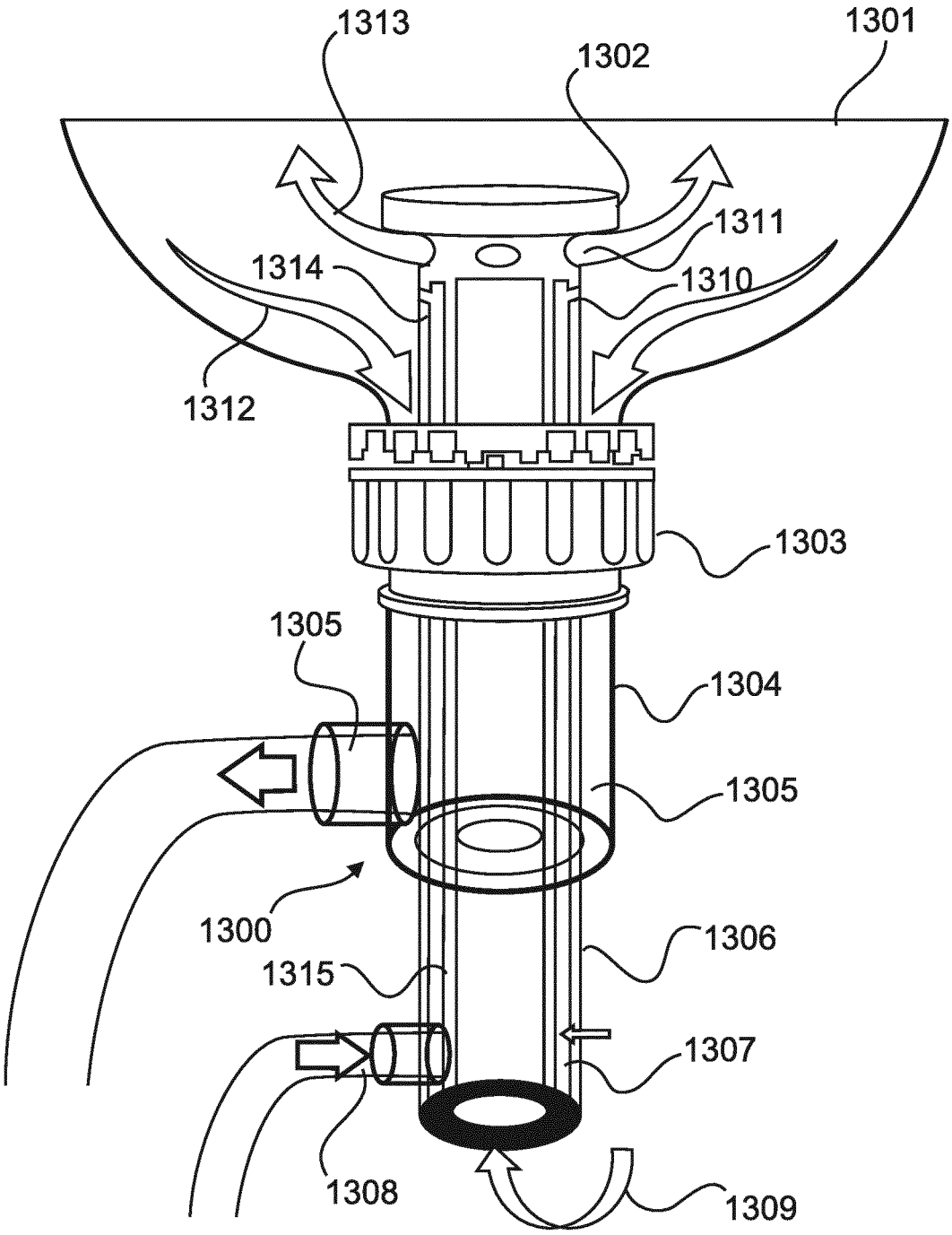

FIG. 13 schematically shows a coupling device according to another exemplary embodiment of the present invention.

Figure 14:
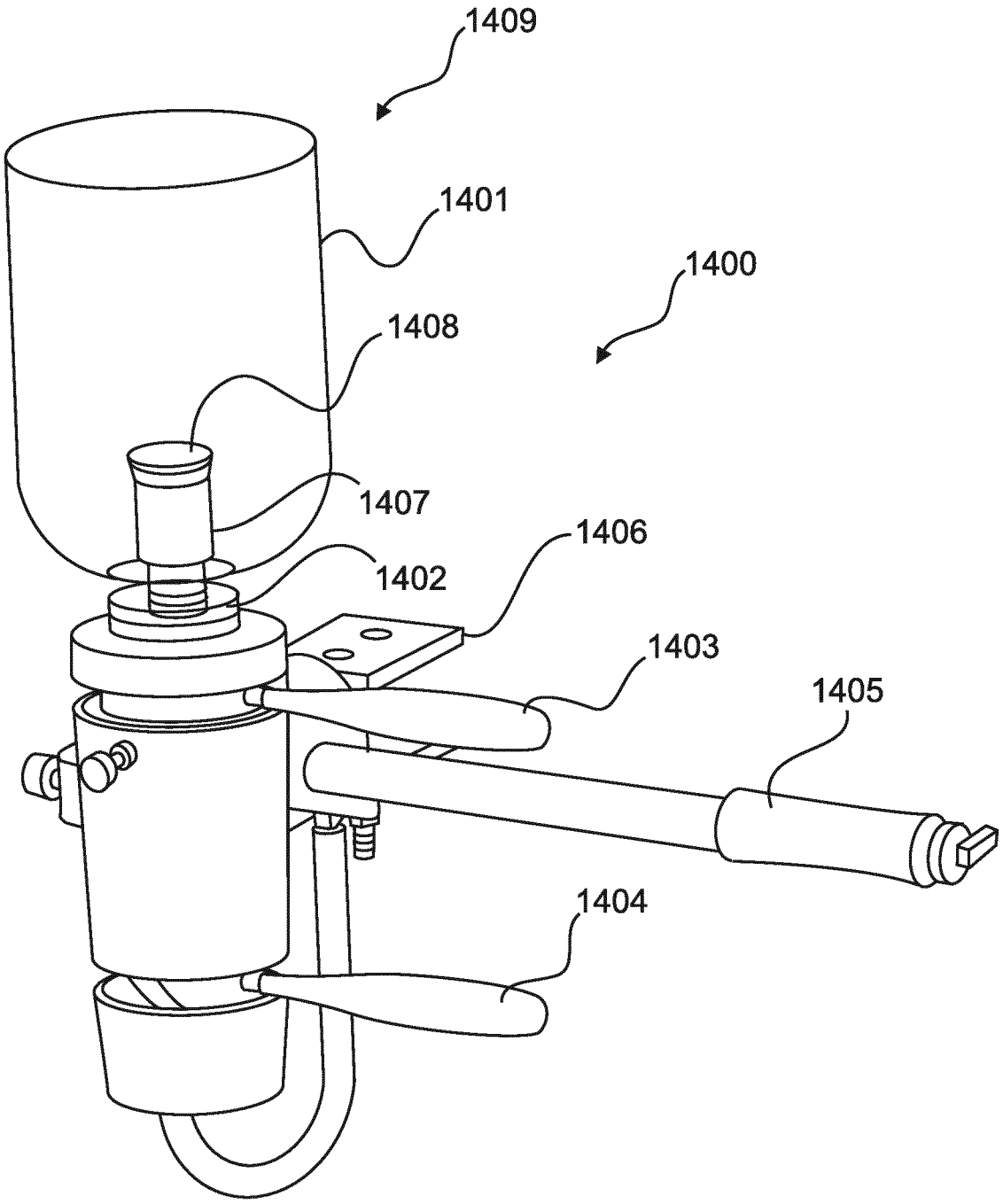

FIG. 14 schematically shows another exemplary embodiment of a coupling device according to another exemplary embodiment of the present invention.

Figure 15:
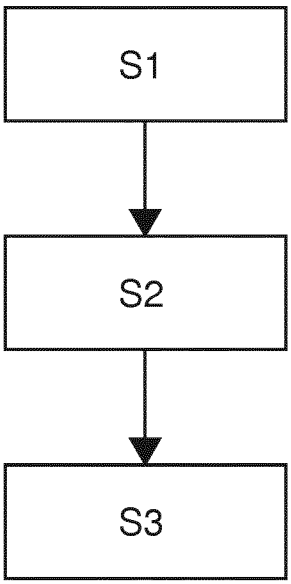

FIG. 15 schematically shows a flow diagram of a method of mechanically coupling a coupling device to a cap of the container according to another exemplary embodiment.

Figure 16:
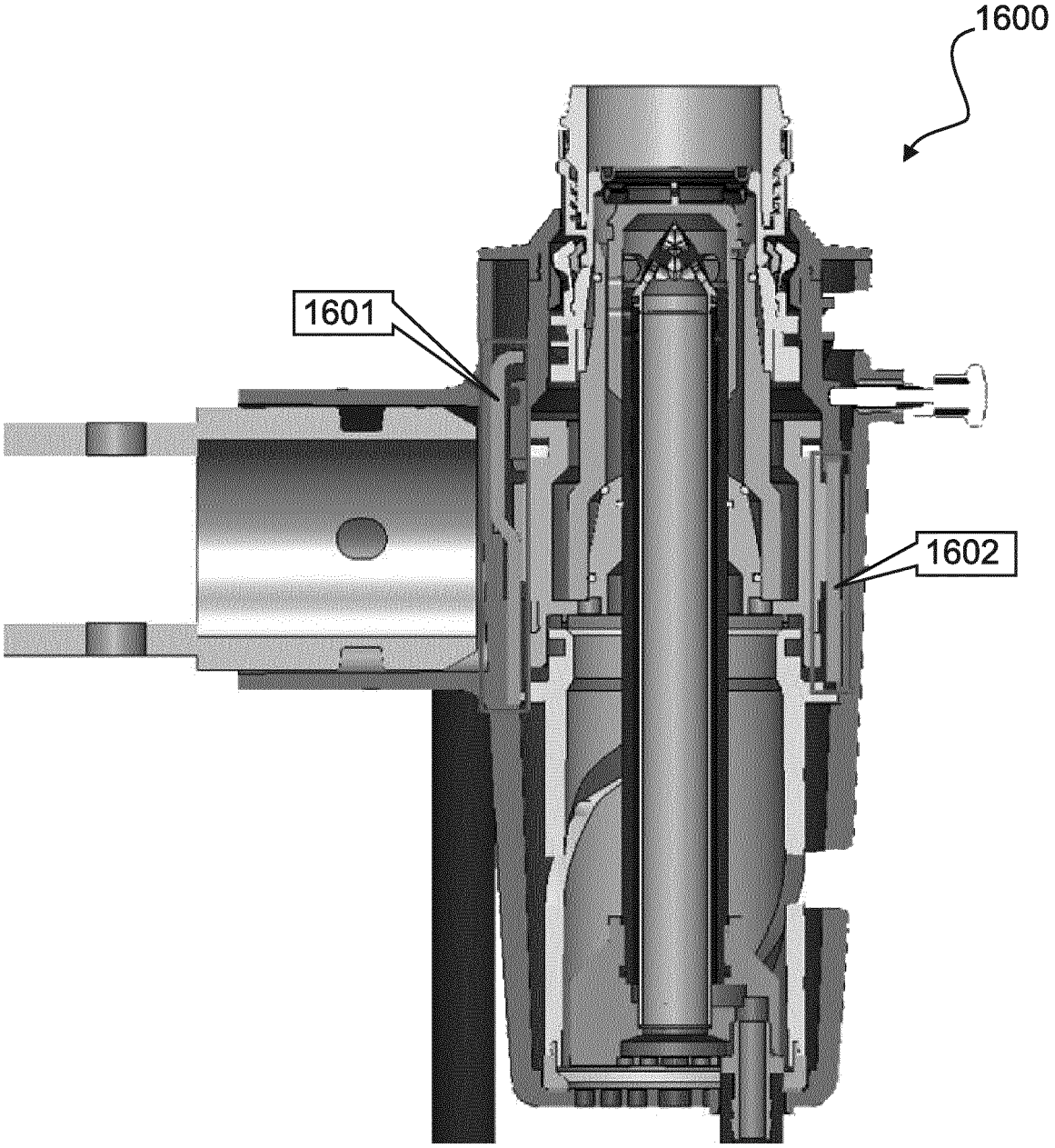

FIG. 16 schematically shows a coupling device according to another exemplary embodiment of the present invention.

DETAILED DESCRIPTION OF EMBODIMENTS

Before the general idea of the present invention, i.e. the provision of a coupling device with two different mechanisms, as defined in the independent claims is explained in the context of several general embodiments shown in FIGS. 12 to 14, a non-limiting specific embodiment example is described in detail in the context of FIGS. 1 to 10. This embodiment facilitates an overall explanation of several different mechanical functionalities, which could also be realized separately in different embodiments of the coupling device and the corresponding method. Thus, the disclosure of the specific embodiment of FIGS. 1 to 10 shall not be interpreted as if all the functionalities comprised by this embodiment must be part of each coupling device and method according to the present invention. This has already been explained in detail hereinbefore and will also be elucidated with the following explanations.

FIG. 1 schematically shows a coupling device 100 configured to be mechanically coupled to a cap 102 of a container 123 to be in a coupled configuration according to an exemplary embodiment of the present invention. The coupling device 100 comprises a probe 124 which is to be inserted into an opening of the cap 102. The coupling device 100 is configured, when in the coupled configuration, to disengage the closure insert 101 of the cap 102 from the cap 102 by axially pushing the closure insert with the probe 124. The coupling device further comprises a first mechanism which is configured for drawing the cap 102 and the container 123 towards the coupling device 100 for sealing and locking the cap 102 and the coupling device 102 into a desired position. Device 100 further comprises a second mechanism configured for axially moving the probe 124 to thereby lift the probe 124 with the closure insert 101 into the container 123. The first mechanism of coupling device 100 comprises a first lever 111 for operating the first mechanism and the second mechanism comprises a second lever 118 for operating the second mechanism. In this embodiment, the first mechanism is realized as a motion link mechanism converting a linear or rotational movement of the first lever 111 into a rotation which is used for drawing the cap 102 and the container 123 towards the coupling device 100. The second mechanism is embodied as a motion link mechanism converting a linear or rotational movement of the second lever 118 of the second mechanism into a rotation which is used for axially moving the probe 124 to thereby lift the probe 124 with the closure insert 101 into the container 123. The coupling device 100 is a mono probe coupling device comprising only a single probe 124. As can been seen from FIG. 1 the device 100 comprises a housing 120, and the first and second mechanisms, with the exception of the first lever 111 of the first mechanism and the second lever 118 of the second mechanism, are both contained within the housing 120. Thus, the first and second mechanisms are configured to be operated separately. In addition, as will be explained in the context of the following FIGS. 2-10, the first mechanism is configured for preventing at the same time misuse by blocking any unintended movement of the second lever 118, and the second mechanism is configured for preventing at the same time misuse by blocking any unintended movement of the first lever 111.

Furthermore, the coupling device 100 comprises a suction gate 112 for sucking liquid through the coupling device 100 out of the container 123. As will become apparent from the following explanation the first and second mechanisms are configured for providing an adjustment of a size of an opening of the suction gate 112 which is independent from a current axial position of the probe 124. The first mechanism comprises a claw element 103 for drawing the cap 102 and the container 123 towards the coupling device 100 and for locking the container 123 and the cap 102 into the desired position. The first lever 111 is configured to be moved from a start position, shown in FIGS. 1 and 2 towards an end position, shown e.g. in FIG. 5. The first lever 111 is operatively connected to the claw element 103 and is configured upon movement from the start position into a locking position, which is between the start and the end position, to radially move the claw element.

In particular, the first lever 111 is configured to be rotated for operating the first mechanism. The first mechanism further comprising a clamp cylinder 105 and a transfer cylinder 107 comprising a motion link. The first lever 111 is connected to the transfer cylinder 107 such that the transfer cylinder 107 follows the rotation of the first lever 111. Further, the transfer cylinder 107 is configured upon the rotation caused by the first lever 1111 to axially move the clamp cylinder 107. The clamp cylinder is configured upon its axial movement to radially and axially move the claw element. In the context of the present invention an axial movement shall be understood as a movement along the main axis of the probe, shown in FIG. 1 in vertical direction. The coupling device further comprises a suction gate, comprising gate element 112 and outlet 114, wherein the opening defined by the suction gate 112, 114 is closed in the start position of the first lever 111 shown in FIG. 1. As can be seen from the following FIGS. 2-4, the first mechanism is configured upon moving the first lever 111 from the start position (see FIG. 1) to an intermediate position (see FIG. 4) to open the opening of the suction gate 112, 114. Moreover, the first mechanism is configured upon moving the first lever 111 from the intermediate position (see FIG. 4) to the end position (see FIG. 5) to re-close the opening of the suction gate 112, 114.

The second mechanism of coupling device 100 also comprises a lifter 119 which comprises a second motion link. The second lever 118 is configured to be moved from a start position (see FIG. 1) towards an end position (see e.g. FIGS. 9 and 10). The second lever 118 is connected with the lifter 119 and is configured upon movement from the start position to the end position to move the lifter 119. The lifter 119 is configured to axially move the probe 124 by the second motion link when the lifter 119 is moved by the second lever 118. Moreover, the second mechanism is configured upon movement of the second lever 118 from the start position (see FIG. 1) towards the end position (see e.g. FIGS. 9 and 10) to gradually open the opening defined by the suction gate 112, 114. Also this aspect will be explained in more details hereinafter. Using the coupling device 100 the user can rinse outer parts of the cap and the closure insert 101 inner parts of the coupling device 100 and transfer lines of the coupling device 100 in the coupled configuration in which the closure insert 101 fluid tightly closes the opening of the cap 102. Important is as well an efficient rinsing of the container inner walls and the bottom, which can be achieved with the coupling device of the present invention, in particular with the embodiment disclosed here.

In particular, the embodiment using a single probe coupling device 100 may exceed the performance of previously used and known double probe devices. The inventors of the present invention found that with the single probe device it is much easier to enter the probe further into the container reducing the static fluid pressure by reducing significantly the deformation of the bottles and increasing the emptying speed. Furthermore, by combining everything into concentric tubes, space could be economized so that the air tube could be separated from the rinsing tube. This additional functionality would have required a triple probe approach, which would not have fit into the available space. Having air and rinsing water separated, eliminated the container deformation that had been observed with dual probe constructions of the prior art during rinsing. This improves the rinsing efficacy of the coupling device of the present invention.

In the following, a step wise description of a possible use of the coupling device 100 is described to emphasize the several different advantages of the coupling device 100.

In step 1, shown in FIG. 2, the container, which preferably is a Crop Protection Product (CPP) container 123 with the cap 102, including plug 101 is placed upside down on the coupling device 100. The cap sits on the clamp cylinder 105 and the clamp cylinder supports the weight of the container. Both levers 111, 118 are in the start position on the left side of the coupling device.

In step 2, shown in FIG. 3, the upper lever 111 is turned from the start position counter-clockwise. This movement simultaneously turns the transfer cylinder 107. The motion link imbedded in the transfer cylinder moves the clamp cylinder 105 downwards. This movement causes the claw to move towards the centre of the coupling device 100. By this movement the rim of the cap 102 is gripped by the claw and mechanically secured.

Step 3 is shown in FIG. 4. In continuation of the turning of the upper lever 111, the clamp cylinder 105 is further moved down pulling the cap 102 over an O-ring imbedded in the upper tube of the outlet 114. This movement seals the cap and the outlet in a leak-tight connection. Simultaneously, the another motion link imbedded in the transfer cylinder 107 causes the gate 112 to move downwards opening a gap between the gate 112 and the outlet 114. This position allows rinsing the interior of the coupling device 100 while the container is closed by the closure insert 101. This functionality is essential when only a part of the content of the container 123 is removed from the container 123.

In step 4, shown in FIG. 5, the 180° counter-clockwise turn of the upper lever 111 is completed, the container 123 is mechanically linked to the coupling device 100 and connected in a leak-tight manner with the outlet 114. The container is still closed by the plug 101 in the cap 102. The gate is closed again by a movement caused by the motion link in the transfer cylinder 107.

In step 5, shown in FIG. 6, by turning the lower lever 118 counter-clockwise, the motion link in the lifter 119 causes the air and water intake 121 to move upwards together with the probe. Thus connecting the probe head 104 with the plug 101.

In step 6, shown in FIG. 7, the continuation of the turning movement of the lower lever 118 dislodges the plug 101 from the cap 102 and fixes it on top of the probe head 106.

In step 7, shown in FIG. 8, in continuation of the turning movement of the lower lever 118 the increasing steepness of the motion link in the lifter 119 causes the probe to move up to the highest position.

In step 8, shown in FIG. 9, in completion of the 180° counter-clockwise turn of the lower lever 118 the motion link imbedded in the lifter probe top 116 causes the gate 112 to gradually open until it reaches the completely open position. The ability to gradually open the gate is essential to allow an accurate dosing of the product contained in the container, e.g. CPP, by being able to modify the emptying speed from zero to maximum by turning the lower lever. During the emptying process, the volume of liquid displaced is compensated by air flowing in through the probe air channel 110 and the air head 106. Thus, avoiding a deformation of the container 123 during the emptying process.

In step 9, shown in FIG. 10, after having emptied the container 123, the inner surface of the container can be rinsed by activating the rinsing water valve 115. This allows rinsing water provided by a hose through the water inlet 117 to flow through the rinsing water valve into the hose that connects the rinsing water valve with the water tube 122 at the bottom of the coupling device 100. The rinsing water flows through the air and water intake 121 into the probe water channel 110 and is dispensed at high pressure through holes in the probe head 104 into the container. This allows a thorough rinsing of the inner surface of the container, in particular if CCP is contained in the CPP container, to a degree that is acceptable for the container recycling industry.

The emptying and rinsing cycle can be completed by working all steps backwards from step 9 to step 1, pausing at step 3 to rinse the outer part of the cap, the inner part of the coupling device 100 and the transfer lines. This is essential when only a part of the content, e.g. of CPP, contained in the container has been removed. In this situation, the inner part of the container is not rinsed. The rinsing procedure described is imperative to ensure the complete transfer of the product aliquot and remove any contamination from accessible surfaces.

In other words, the suction gate may be seen as a valve which can be used for the following two purposes. First, when the product is transferred out of the container. This is the case in this embodiment when the upper lever is positioned at 3 o'clock and the lower lever is positioned from 6 to 3 o'clock such that little to a lot suction can be adjusted. Second, when the outer side of the closure insert and the coupling device 100 with hoses is rinsed. In this embodiment this is the case when the upper level is at 6 o'clock position and the lower level is at 9 o'clock position. To open the suction only at a certain position is an important feature of this embodiment to prevent that air is constantly sucked into the sprayer tank and causes foaming, this embodiment allows flushing the closure insert outside properly.

In a particular embodiment, the coupling device comprises a blocking mechanism. The blocking mechanism is configured to block the second lever as long as the first lever is not in its end position. Furthermore, the blocking mechanism is configured to then block the first lever as soon as the second lever is moved away from its start position.

Figures 11A, 11B, 11C, 11D:
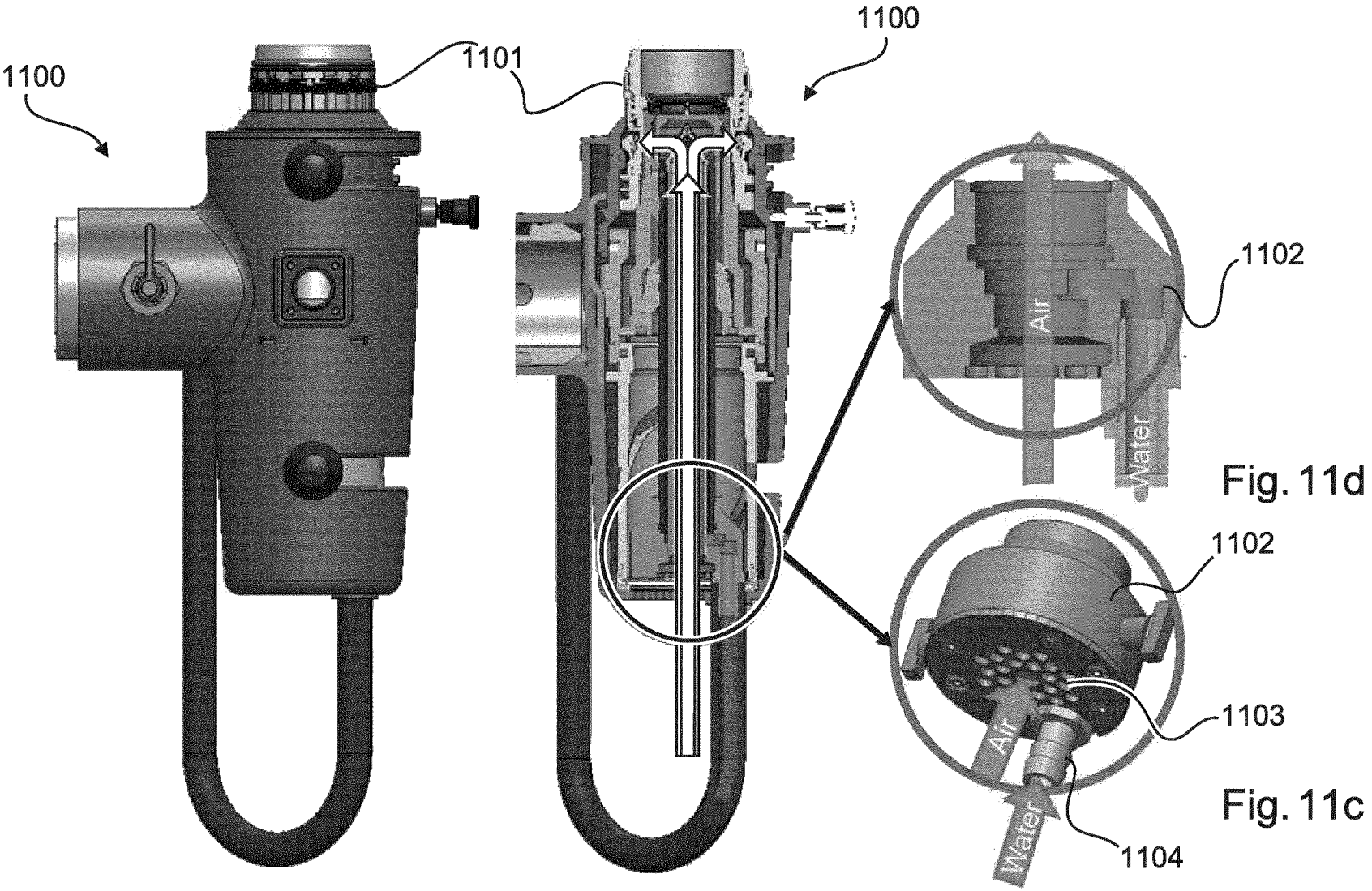

FIG. 11 schematically shows another exemplary embodiment of a coupling device 1100. The embodiment of FIG. 11 is specifically shown to explain the air and water intake element 1102. Several different openings at the lower surface of air water intake 1102 are depicted in FIG. 11*c* and are shown with reference sign 1103. Water can be guided through water inlet valve 1104. The air and water intake element 1102 can be combined with any other embodiment as mentioned hereinafter and hereinbefore.

Furthermore, FIGS. 12*a* and *b* schematically shows another coupling device 1200 at which the supply of rinsing water 1201 is shown in detail. Hose 1202 is used to guide water to the lower section of housing 1203. The rinsing water valve 1204 is depicted in FIG. 12*b* in a cross-sectional view. Guiding the water in this way, saves space and allows the hose to follow the vertical movement of the probe. It allows as well the activation of the rinsing valve by the Bowden cable.

According to another exemplary embodiment of the present invention, a coupling device 1300 is disclosed. The coupling device 1300 comprises a first tube 1315, a second tube 1306, and a third tube 1304, which are provided in a concentric configuration. Thus, the first tube is enclosed by the second tube and the third tube, and the second tube is enclosed by the third tube. The first tube is configured for guiding air 1309 into the inner part of the container 1301. Air inlet openings 1311 are shown. The air may thus expand 1313 within the interior of container 1301. In the configuration shown in FIG. 13, the probe extends into the interior of the container and carries the closure insert 1302. The second tube 1306 is configured to guide rinsing water 1307 which enters the coupling device via rinsing water inlet 1308. Moreover, liquid 1312, 1305 is sucked out of the container through the volume which extends between the third tube 1304 and the second tube 1306. The cap 1303 is shown as well. Also rinsing water outlet openings 1310 are shown in FIG. 13

According to another exemplary embodiment, FIG. 14 shows a system 1409 for draining and venting a container 1401 in combination with a coupling device 1400. The coupling device of FIG. 14 also comprises first and second levers 1403, 1404 and also comprises a third lever 1405 for rotating the entire coupling device 1400 when it is fixed at e.g. a crop protection spray system. Attachment means 1406 are shown at the coupling device which facilitate securing the coupling device 1400 at for example a crop protection spraying system. The embodiment of FIG. 14 is a mono probe coupling device since it comprises only the single probe 1407 to which the closure insert 1408 is releasably attached. Due to the construction of this coupling device, rinsing the walls as well as the bottom of the container is advantageously facilitated.

According to another exemplary embodiment of the present invention, FIG. 15 shows a flow diagram of a method of mechanically coupling a coupling device to a cap of a container. In a first step, the container is placed onto a coupling device in step S1. The container comprises at least one inlet opening and the cap is attached to the inlet opening which closes the inlet opening. The cap also comprises an opening and a closure insert. In a further step, a first mechanism device is used for drawing the cap and the container towards the coupling device thereby sealing and locking the cap and the coupling device 100 in a desired position at the coupling device. This step is depicted in FIG. 15 with step S2. Moreover, a second mechanism of the coupling device is used to actually move a probe of the coupling device thereby disengaging the closure insert of the cap from the cap and thereby lifting the probe with the cap into the container.

FIG. 16 schematically shows a coupling device 1600 according to another exemplary embodiment of the present invention. In this embodiment, similar to the embodiment of FIG. 1, the first and second mechanisms are configured to be operated separately. At the same time, the first mechanism is configured for preventing misuse by blocking any unintended movement of the second lever, wherein the second mechanism is configured for preventing at the same time misuse by blocking any unintended movement of the first lever. The coupling device 1600 thus comprises a blocking bar 1601 for the lower lever activated by the transfer cylinder. Further, coupling device 1600 comprises a blocking bar 1602 for the upper lever activated by lifter top. Thus, this coupling device is configured such that a rotation of the transfer cylinder causes a vertical movement of the blocking bar 1601, which blocks the rotation of the lifter. The rotation of the lifter causes the vertical movement of the second blocking bar 1602, which blocks the rotation of the transfer cylinder.

The invention claimed is:

1. A coupling device configured to be mechanically coupled to a cap of a container to be in a coupled configuration, the coupling device comprising:

a probe configured to be inserted into an opening of the cap, wherein the coupling device is configured, when in the coupled configuration, to disengage a closure insert of the cap from the cap by axially pushing the closure insert with the probe, the coupling device further comprising:

a first mechanism configured for drawing the cap and the container towards the coupling device for sealing and locking the cap and the coupling device into a desired position, a second mechanism configured for axially moving the probe to thereby lift the probe with the closure insert into the container, a first tube, a second tube, and a third tube, wherein the first tube is enclosed by the second tube and the third tube, and wherein the second tube is enclosed by the third tube, and wherein the first tube is configured for guiding air through the coupling device into the container, wherein the second tube is configured for rinsing water into the container, and wherein the third tube is configured for sucking liquid out of the container through the coupling device and outside of the coupling device.

2. The coupling device according to claim 1, wherein the first mechanism comprises a first lever, wherein the second mechanism comprises a second lever, wherein the first mechanism is embodied as a motion link mechanism converting a linear or rotational movement of the first lever of the first mechanism into a rotation, and wherein the second mechanism is embodied as a motion link mechanism converting a linear or rotational movement of the second lever of the second mechanism into a rotation.

3. The coupling device according to claim 2, further comprising:

a housing, and wherein the first and second mechanisms except the first lever of the first mechanism and the second lever of the second mechanism are both contained within the housing.

4. The coupling device according to claim 1, wherein the first and second mechanisms are configured to be operated separately.

5. The coupling device according to claim 4, wherein the first mechanism is configured for preventing at the same time misuse by blocking any unintended movement of the second lever, and wherein the second mechanism is configured for preventing at the same time misuse by blocking any unintended movement of the first lever.

6. The coupling device according to claim 1, wherein the coupling device is a mono probe coupling device comprising only a single probe.

7. The coupling device according to claim 1, wherein the coupling device further comprises a suction gate for sucking liquid through the coupling device out of the container, and wherein the first and second mechanisms are configured for providing an adjustment of a size of an opening of the suction gate which adjustment is independent from a current axial position of the probe.

8. The coupling device according to claim 1, wherein the first mechanism comprises a first lever for operating the first mechanism, wherein the first mechanism comprises a claw element for drawing the cap and the container towards the coupling device and for locking the container and the cap into the desired position, wherein the first lever is configured to be moved from a start position towards an end position, and wherein the first lever is operatively connected to the claw element and is configured upon movement from the start position into a locking position to radially move the claw element.

9. The coupling device according to claim 8, wherein the first lever is configured to be rotated for operating the first mechanism, the first mechanism further comprising a clamp cylinder, the first mechanism further comprising a transfer cylinder comprising a motion link, wherein the first lever is connected to the transfer cylinder such that the transfer cylinder follows a rotation of the first lever, wherein the transfer cylinder is configured upon the rotation caused by the first lever to axially move the clamp cylinder, and wherein the clamp cylinder is configured upon its axial movement to radially and axially move the claw element.

10. The coupling device according to claim 8, further comprising:

a suction gate, wherein an opening defined by the suction gate is closed in the start position of the first lever, wherein the first mechanism is configured upon moving the first lever from the start position to an intermediate position to open the opening of the suction gate, and wherein the first mechanism is configured upon moving the first lever from the intermediate position to the end position to re-close the opening of the suction gate.

11. The coupling device according to claim 1, wherein the second mechanism comprises a second lever, wherein the second mechanism comprises a lifter which comprises a second motion link, wherein the second lever is configured to be moved from a start position towards an end position, wherein the second lever is connected with the lifter and is configured upon movement from the start position to the end position to move the lifter, and wherein the lifter is configured to axially move the probe by the second motion link when the lifter is moved by the second lever.

12. The coupling device according to claim 11, wherein the second mechanism is configured upon movement of the second lever from the start position towards the end position to gradually open the opening defined by the suction gate.

13. The coupling device according to claim 1, wherein the coupling device is configured for rinsing outer parts of the cap and the closure insert, inner parts of the coupling device and transfer lines of the coupling device in a coupled configuration in which the closure insert fluid tightly closes the opening of the cap.

14. A system for draining and venting a container, the system comprising:

a coupling device according to claim 1, and a container comprising, a container body with at least one inlet opening, and a cap for closing the inlet opening of the container body, wherein the cap is attached to the inlet opening of the container body, wherein the cap comprises an opening, wherein the cap comprises a closure insert, wherein the closure insert releasably engages with the cap such that the opening of the cap is fluid tightly closed.

15. The system according to claim 14, further comprising:

a crop protection spray system.

16. The coupling device according to claim 1, wherein the first tube, the second tube and the third tube are arranged concentrically in the coupling device.

17. A method of mechanically coupling a coupling device to a cap of a container, the method comprising the steps of:

placing the container onto a coupling device (S1), wherein a container body comprises at least one inlet opening and a cap attached to the inlet opening closing the inlet opening, wherein the cap comprises an opening and a closure insert, wherein the coupling device comprises a first tube, a second tube and a third tube, wherein the first tube is enclosed by the second tube and the third tube, and wherein the second tube is enclosed by the third tube, wherein the first tube is configured for guiding air through the coupling device into the container, wherein the second tube is configured for rinsing water into the container, and wherein the third tube is configured for sucking liquid out of the container through the coupling device and outside of the coupling device, the method further comprising the steps of:

using a first mechanism of the coupling device for drawing the cap and the container towards the coupling device thereby sealing and locking the cap and the coupling device in a desired position at the coupling device (S2), and using a second mechanism of the coupling device to axially move a probe of the coupling device thereby disengaging the closure insert of the cap from the cap and thereby lifting the probe with the cap into the container (S3).

18. The method according to claim 17, further comprising:

rinsing outer parts of the cap, inner parts of the coupling device and transfer lines of the coupling device (S4), wherein the rinsing is carried out in a coupled configuration in which the closure insert fluid tightly closes the opening of the cap, and wherein the rinsing is carried out by guiding a liquid through the coupling device towards the outer parts of the cap.

19. The method according to claim 17, wherein the first tube, the second tube and the third tube are arranged concentrically in the coupling device.

* * * * *